US011615668B2

(12) United States Patent
Peterson et al.

(10) Patent No.: US 11,615,668 B2
(45) Date of Patent: Mar. 28, 2023

(54) GAMING SYSTEMS AND METHODS FOR PROVIDING A SLIDING SYMBOL OPERATION

(71) Applicant: IGT, Las Vegas, NV (US)

(72) Inventors: Chris Peterson, Reno, NV (US); Nick Hillstrom, Reno, NV (US); Yu Chong, Reno, NV (US); Nathan Ajhar, Sparks, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 17/211,361

(22) Filed: Mar. 24, 2021

(65) Prior Publication Data

US 2022/0309866 A1 Sep. 29, 2022

(51) Int. Cl.
*G07F 17/32* (2006.01)

(52) U.S. Cl.
CPC ..... *G07F 17/3213* (2013.01); *G07F 17/3209* (2013.01); *G07F 17/3244* (2013.01); *G07F 17/3265* (2013.01)

(58) Field of Classification Search
CPC ..... G07F 17/3265
See application file for complete search history.

(56) References Cited

U.S. PATENT DOCUMENTS 7,070,503 B2 * 7/2006 Rudolph ..... G07F 17/3265 463/13
8,147,334 B2 4/2012 Gatto et al.
8,764,566 B2 7/2014 Miltenberger et al.
9,120,010 B2 * 9/2015 Karn ..... A63F 13/00
10,311,676 B2 * 6/2019 Carlson ..... G07F 17/3265
10,636,243 B1 * 4/2020 Davis ..... G07F 17/3213
10,733,833 B2 * 8/2020 Maddux ..... G07F 17/3244
2004/0033829 A1 * 2/2004 Pacey ..... G07F 17/3265 463/20
2009/0124357 A1 * 5/2009 Acres ..... G07F 17/32 463/25
2009/0227353 A1 * 9/2009 Yoshizawa ..... G07F 17/3267 463/20
2010/0285860 A1 * 11/2010 Svanas ..... G07F 17/32 463/20
2011/0098099 A1 * 4/2011 Acres ..... G07F 17/3211 463/20
2013/0331166 A1 * 12/2013 Carranza ..... G07F 17/3267 463/20
2014/0179413 A1 * 6/2014 Thompson ..... G07F 17/3209 463/25
2019/0172304 A1 * 6/2019 Koc ..... G07F 17/34
2019/0378378 A1 * 12/2019 Bolling, Jr. ..... G07F 17/34

* cited by examiner

*Primary Examiner* — Dmitry Suhol
*Assistant Examiner* — Jason Pinheiro
(74) *Attorney, Agent, or Firm* — Sheridan Ross P.C.

(57) ABSTRACT

The present disclosure relates generally to systems and methods for providing sliding symbol operations in grid-base games. The sliding symbol operations allow a player of the gaming device to move, by sliding or dragging, a particular symbol from one cell to another in an array of cells between plays of the grid-based game. Movement of the particular symbol from one cell to another allows a player to control their chances of winning and alter the proposed payouts for winning sequences of symbols for at least one subsequent play of the grid-based game.

13 Claims, 13 Drawing Sheets

GAMING SYSTEMS AND METHODS FOR PROVIDING A SLIDING SYMBOL OPERATION

BACKGROUND

The present disclosure is generally directed to gaming systems and, in particular, toward gaming systems that enable sliding symbol operations for grid-based games.

Gaming machines typically offer a number of built-in game play features that contribute to the overall player experience. Any type of game play feature that presents the player with an additional opportunity to win is often viewed as desirable and can lead to increased play of the gaming machine.

BRIEF SUMMARY

In certain embodiments, the present disclosure relates to a device, method, and system that provide sliding symbol operations for grid-based (e.g., reel-spin, matching, etc.) gaming devices. In some embodiments, a gaming device is provided, comprising: a display device; a processor coupled to the display device; and a memory coupled with and readable by the processor and storing therein instructions that, when executed by the processor, cause the processor to: receive a first input from a player interacting with the gaming device initiating a first play of a grid-based game, the grid-based game arranged as an array of cells having a presentation order defining a specific position of each cell in the array of cells relative to one another; render, by the display device in response to receiving the first input, a randomly-generated first sequence of symbols to the array of cells, each cell in the array of cells comprising a discrete symbol in the first sequence of symbols; receive a symbol movement input from the player interacting with the gaming device dragging a particular symbol in the rendered first sequence of symbols from a first cell in the array of cells to a second cell in the array of cells; receive a second input from the player interacting with the gaming device initiating a second play of the grid-based game with the particular symbol maintained in the second cell; render, in response to receiving the second input, the particular symbol in the second cell and a randomly-generated second sequence of symbols to the array of cells other than the second cell; and determine, based on a position of the particular symbol and a position of each symbol in the second sequence of symbols relative to the presentation order, a game outcome of the second play of the grid-based game.

In some embodiments, a method is provided, comprising: receiving, by a processor of a gaming device, a first input from a player interacting with the gaming device initiating a first play of a grid-based game, the grid-based game arranged as an array of cells having a presentation order defining a specific position of each cell in the array of cells relative to one another; rendering, by a display device of the gaming device in response to receiving the first input, a randomly-generated first sequence of symbols to the array of cells, each cell in the array of cells comprising a discrete symbol in the first sequence of symbols; receiving, via a user interface of the gaming device, a symbol movement input from the player interacting with the gaming device dragging a particular symbol in the rendered first sequence of symbols from a first cell in the array of cells to a second cell in the array of cells; receiving, via the user interface of the gaming device, a second input from the player interacting with the gaming device initiating a second play of the grid-based game with the particular symbol maintained in the second cell; rendering, by the display device of the gaming device in response to receiving the second input, the particular symbol in the second cell and a randomly-generated second sequence of symbols to the array of cells other than the second cell; and determining, by the processor of the gaming device based on a position of the particular symbol and a position of each symbol in the second sequence of symbols relative to the presentation order, a game outcome of the second play of the grid-based game.

In some embodiments, a system is provided, comprising: a processor; and a computer-readable storage medium, coupled with the processor, comprising instructions that are executable by the processor, wherein the instructions comprise: instructions that initiate a first play of a grid-based game, the grid-based game arranged as an array of cells having a presentation order defining a specific position of each cell in the array of cells relative to one another; instructions that, in response to receiving the first input, cause a randomly-generated first sequence of symbols to be rendered to the array of cells, each cell in the array of cells comprising a discrete symbol in the first sequence of symbols; instructions that receive a symbol movement input dragging a particular symbol in the rendered first sequence of symbols from a first cell in the array of cells to a second cell in the array of cells; instructions that initiate a second play of the grid-based game with the particular symbol maintained in the second cell; instructions that, in response to receiving the second input, cause the particular symbol to be rendered in the second cell and a randomly-generated second sequence of symbols to be rendered to the array of cells other than the second cell; and instructions that, based on a position of the particular symbol and a position of each symbol in the second sequence of symbols relative to the presentation order, determine a game outcome of the second play of the grid-based game.

Additional features and advantages are described herein and will be apparent from the following Description and the figures.

DETAILED DESCRIPTION

Figure 1A:
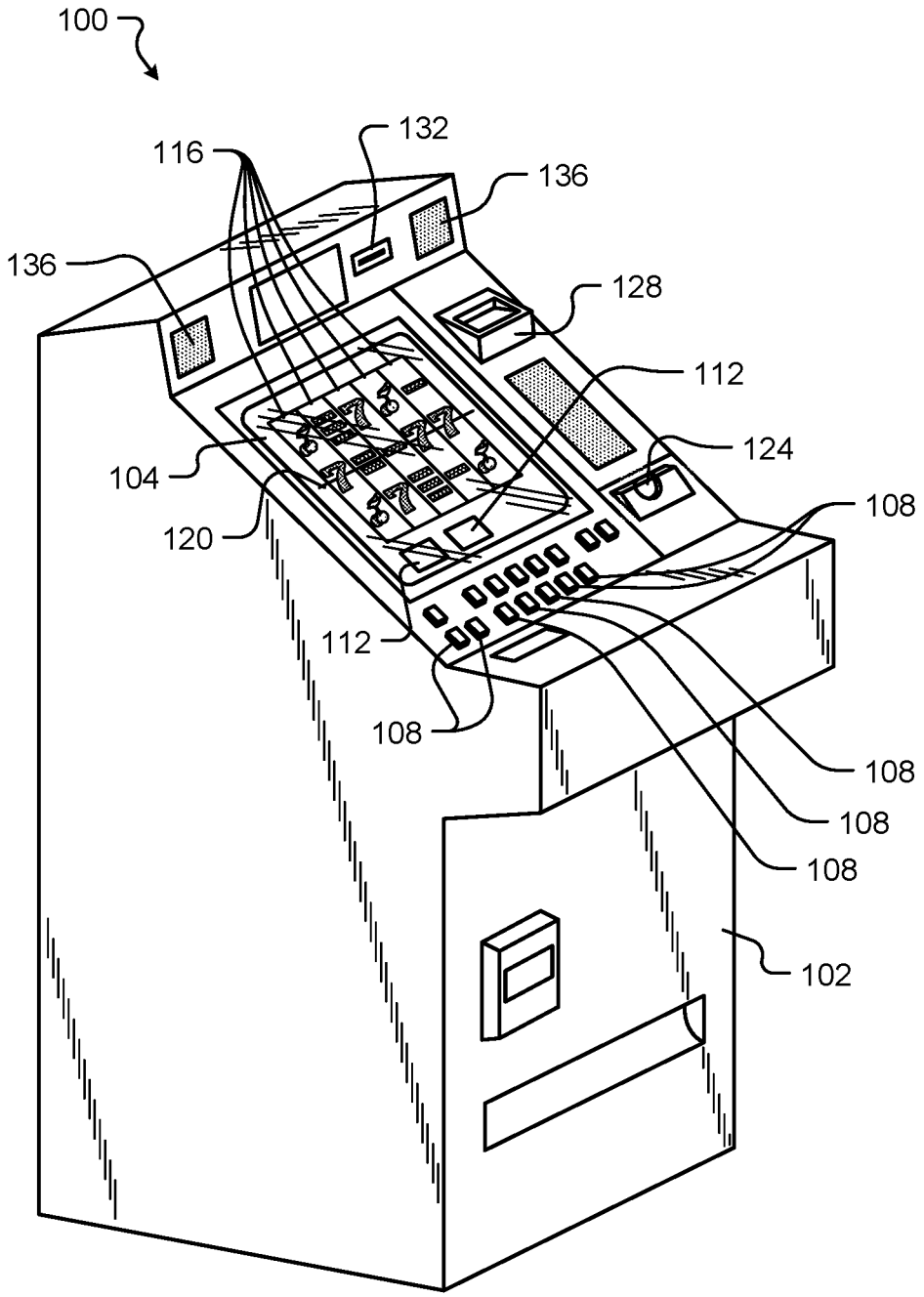
FIG. 1A depicts one example of a computational gaming device for enabling enhanced gaming features and sliding symbol operations.

Embodiments of the present disclosure will be described in connection with gaming systems having one or multiple gaming devices that are capable of providing sliding symbol operations in a grid-based game. The sliding symbol operations allow a player of the gaming device to move (e.g., via a drag operation, etc.) a particular symbol from one cell to another in an array of cells between plays of the grid-based game. Movement of the particular symbol from one cell to another allows a player to control their chances of winning and alter the proposed payouts for winning sequences of symbols for at least one subsequent play. The gaming devices may comprise a computational device, such as a slot machine or Electronic Gaming Machine (EGM), that implements a sliding symbol and subsequent play operation. While embodiments of the present disclosure will be described in connection with the example of a slot machine, or EGM implementing sliding symbol operations, it should be appreciated that embodiments of the present disclosure are not so limited. For instance, other types of computational devices, such as portable user devices, smartphones, tablets, laptops, Personal Computers (PCs), wearable devices, etc. may be used to implement game enhancement features as part of a game as described herein. Furthermore, it should be appreciated that embodiments of the present disclosure may apply to games other than slot games. For instance, embodiments of the present disclosure may be used in connection with any type of grid-based game such as bingo, keno, slots, matching games, table games, etc.

During regular play, a random "slidable symbol" may be rendered to any cell in the array of cells of the grid-based game. The slidable symbol may be a particular symbol in a sequence of symbols that is part of an array of cells, where the particular symbol is associated with a sliding symbol feature or operation. In some embodiments, an identifying mark (e.g., a crosshair type of symbol, highlight, underscore, star, etc.) may be rendered along with the slidable symbol (e.g., via a display screen of the gaming device, etc.). The identifying mark may indicate that the player can drag, or slide, the slidable symbol from one cell to another, in any direction, in the array of cells to maintained in that "dragged-to" cell, or position, for a subsequent play of the grid-based game. In one embodiment, the slidable symbol may be maintained in the dragged-to cell for a number of plays or spins. The number of plays the slidable symbol may persist in the dragged-to cell may be tied to a bet level. For example, higher bet amounts, or higher betting frequency, compared to at least one predetermined threshold amount and/or frequency, may cause the number of plays to increase. Conversely, lower bet amounts, or lower betting frequency, compared to the at least one predetermined threshold amount and/or frequency, may cause the number of plays to decrease. Additionally or alternatively, the number of plays the slidable symbol may persist in the dragged-to cell may be tied to the position of the slidable symbol relative to the presentation order of the array of cells. For instance, the closer the slidable symbol is to the highest priority position in the array of cells, the fewer the number of plays where the slidable symbol is maintained in the dragged-to cell and vice versa. In some embodiments, the slidable symbol operation may determine a bet amount placed by a player and, based on the bet amount, determine a number of plays are available, or offered, to the player. The number of plays may increase when the bet amount is above a predetermined threshold. Additionally or alternatively, the number of plays may decrease when the bet amount falls below the predetermined threshold.

In any event, the player may have the ability and choice as to where the slidable symbol should be dragged for the next play. This choice may depend on whether the player wishes to increase their chances of winning, increase their payout amount for a winning sequence of symbols, increase the number of plays that the slidable symbol is maintained in the dragged-to cell, etc., and/or combinations thereof. In one embodiment, moving the symbols farther from a higher priority position, or to a lower priority position, in the grid-based game (e.g., farther away from the cell corresponding to the first reel in a slots, or reel-spin, game, etc.) will increase the volatility of the game by, for instance, making it harder to win but allowing the player to win more (e.g., an increased payout amount) in the event of a win. Additionally or alternatively, moving the symbols to a higher priority position in the grid-based game (e.g., closer to, or in, the cell corresponding to the first reel in a slots, or reel-spin, game, etc.) may increase the chances of winning but decrease the payout amount in the event of a win. In some embodiments, the slidable symbol may be moved along a line to any cell in the array of cells, along the line, and may be a part of a sequence of symbols that win along a single payline and/or along multiple paylines.

The slidable symbol may correspond to any symbol in a grid-based game that is able to move from one cell to another cell in the array of cells of the grid-based game. The slidable symbol, as used herein, may be an any symbol (e.g., normal symbol, wild symbol, bonus symbol, multiplier, etc.) used in the grid-based game. The term "slidable symbol," and variations thereof, as used herein may refer to any symbol of the grid-based game that is identified as having the ability to be moved (e.g., by a player, etc.) from one cell to another cell in the array of cells for a subsequent play of the grid-based game. By way of example, the slidable symbol in an electronic reel-spin, or slots, game may correspond to a symbol used in the electronic reel-spin game such as a "seven" symbol, a "fruit" symbol, a "BAR" symbol, a "diamond" symbol, a "gem symbol," a "multiplier" symbol, and/or some other symbol used in the electronic reel-spin game. Continuing this example, when a player spins the reels of the electronic reel-spin game a random number generator may be used to randomly assign these symbols to the cells in the array of cells. The random number generator may be used to randomly assign one symbol in the array of cells as the slidable symbol. In the reel-spin game example, a "cherry" may be defined (e.g., by the rules of the reel-spin game, etc.) as a winning symbol when found in a first position of the presentation order of the array of cells. In some embodiments, the rules of the reel-spin game may define game outcomes for symbol types, symbol types in particular sequences or orders, symbol types in particular cells in the presentation order of the array of cells, and/or the like. If the slidable symbol is a "cherry" disposed in the final position (e.g., the lowest priority position) of a sequence of symbols in the presentation order of the array of cells, the player may select to move the slidable symbol represented by the cherry to the first position (e.g., the highest priority position) for the next play to greatly increase the possibilities of a win in accordance with the rules.

Movement of the slidable symbol may be restricted along a line running through the cell in which the slidable symbol first appeared. In one embodiment, movement of the slidable symbol may be restricted to slide along cells in full rows, full columns, and/or full diagonal lines in the array of cells. The term "full," as used herein, may refer to total number of cells required to produce a sequence of symbols that comport with rules of the grid-based game and produce a game outcome. For example, a reel-spin game (e.g., slots game, etc.) having four separate reels may require four cells, each containing a symbol or an absence of a symbol, to align along a payline to identify the sequence of symbols that produces a particular game outcome. In this example, a total number of four cells arranged along the payline (e.g., a line) comprise the full row that produces the game outcome of the reel-spin game.

The sliding symbol operations and associated features may be activated, as described herein, during play of a grid-based game, after a play of the grid-based game, and/or prior to a play of the grid-based game. As mentioned above, this sliding symbol operation may be made available within the context of a slot game, a matching game, a bingo game, a keno game, a poker machine, or in any other grid-based game of chance that awards particular symbol combinations relative to positions on a user interface.

Among other things, embodiments of the present disclosure provide a player with more ways to win a game, the ability to alter the chances of winning in a game, the ability to alter the payout amount for a winning game outcome, and add excitement to the overall game-playing experience of grid-based games.

Figure 1B:
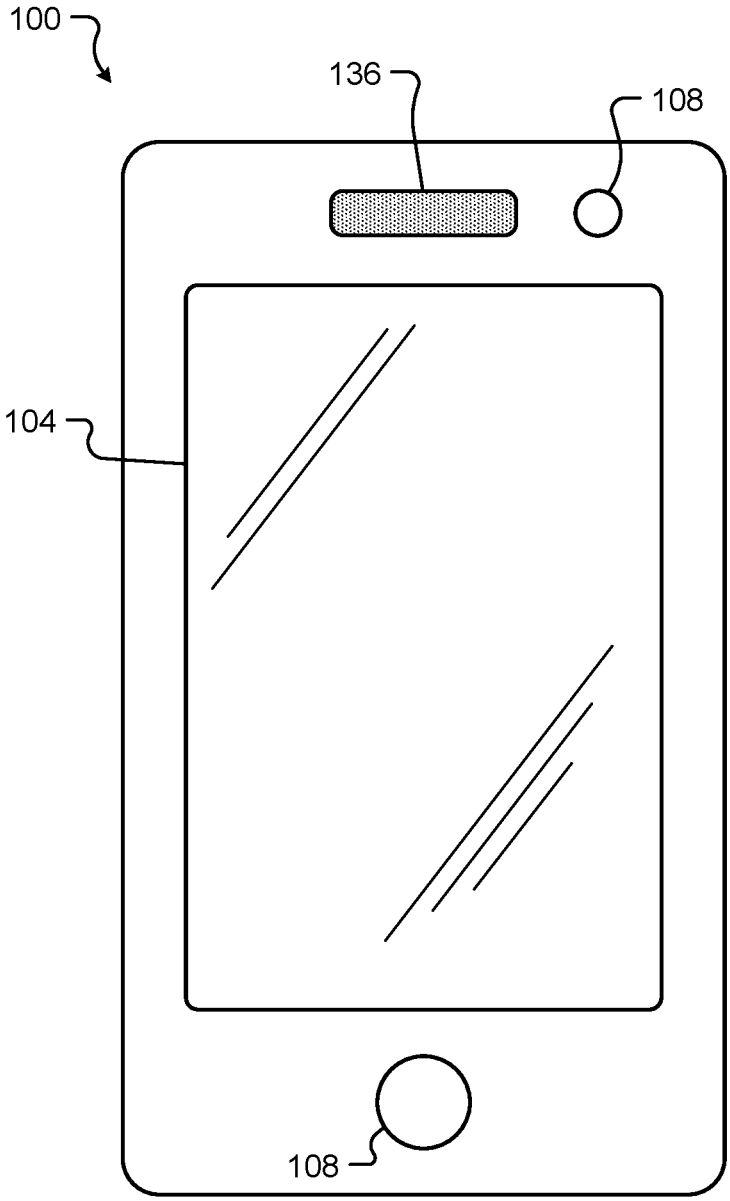
FIG. 1B depicts another example of a computational gaming device for enabling enhanced gaming features and sliding symbol operations.

With reference now to FIGS. 1A and 1B, an illustrative computational device 100 that may be used to implement a grid-based game or the like will be described in accordance with at least some embodiments of the present disclosure. A computational device 100 may include a portable or non-portable device used for executing a gaming application or multiple different gaming applications without departing from the scope of the present disclosure. Non-limiting examples of a computational device include an EGM, a Video Gaming Machine (VGM), a mobile communication device (e.g., a smartphone, laptop, tablet, wearable device, etc.), a personal computer (PC), etc. An EGM or VGM-type of computational device 100 is shown in FIG. 1A in accordance with embodiments of the present disclosure.

The illustrative computational device 100 of FIG. 1A is shown to include a support structure, housing or cabinet, 102 which provides support for a plurality of displays, inputs, controls and other features of a conventional gaming machine. In the illustrated embodiment, a player plays the computational device 100 while sitting, however, the computational device 100 is alternatively configured so that a player can operate it while standing or sitting. The illustrated computational device 100 is positioned on the floor but can be positioned alternatively (i) on a base or stand, (ii) as a pub-style table-top game (e.g., where the participant computational devices are located remotely from the shared wheel as discussed below), (iii) as a stand-alone computational device on the floor of a casino with other stand-alone computational devices, or (iv) in any other suitable manner. The computational device 100 can be constructed with varying cabinet and display configurations.

In one embodiment, a computational device 100 is configured to randomly generate awards and/or other game outcomes based on probability data. Since a computational device 100 generates outcomes randomly or based upon a probability calculation, there is no certainty that the computational device 100 will provide the player with any specific award or other game outcome.

In some embodiments, a computational device 100 may employ a predetermined or finite set or pool of awards, progressive awards, prizes or other game outcomes. As each award or other game outcome is provided to the player, the computational device 100 removes the provided award or other game outcome from the predetermined set or pool. Once removed from the set or pool, the specific provided award or other game outcome cannot be provided to the player again. The computational device 100 provides players with all of the available awards or other game outcomes over the course of the play cycle and guarantees a designated number of actual wins and losses.

The computational device 100 may include one or more displays 112. An illustrative display 112 may include a credit display that displays a player's current number of credits, cash, account balance or the equivalent. Another illustrative display 112 may include a bet display that displays a player's amount wagered.

The computational device 100 is also shown to include at least one payment acceptor. Illustrative payment acceptors may include, without limitation, a coin slot 124, where the player inserts coins or tokens, and a ticket, note, or bill acceptor 128, where the player inserts a bar-coded ticket, note, or cash. In one embodiment, a player-tracking card, credit card, debit card, or data card reader/validator 132 is also provided for accepting any of those or other types of cards as a form of payment toward playing a game on the computational device 100.

In one embodiment, a player inserts an identification card into card reader 132 of computational device 100. The identification card can be a smart card having a programmed microchip or a magnetic strip coded with a player's identification, credit totals, and other relevant information. In one embodiment, money may be transferred to computational device 100 through an electronic fund transfer and card reader 132 using the player's credit, debit, or smart card. When a player funds the computational device 100, a processor of the computational device 100 may determine the amount of funds entered and the corresponding amount is shown on the credit or other suitable display 112 as described above.

In one embodiment, after appropriate funding of computational device 100, the player presses an input device 108 to initiate game play. The input devices 108 may include various types of buttons, levers, gesture inputs, cameras, etc., that enable a player to start any game play or sequence of events. In one embodiment, upon appropriate funding, computational device 100 begins game play automatically. In another embodiment, the player needs to actuate or activate one of the play buttons to initiate play of computational device 100. Other non-limiting types of input devices 108 may include a "bet one" button, a "max bet" button, or any other type of button known to be included in an EGM, VGM, or the like. It should further be appreciated that the input devices 108 may correspond to a physical button, a virtual button on a touch-screen of a game, an input element on a Graphical User Interface (GUI), or a combination thereof. In other words, the input devices 108 do not need to correspond to a physical button. In some embodiments, the player places a bet by pushing a "bet one" button (e.g., betting an amount equal to one credit for the next play). The player may increase the player's wager by one credit each time the player pushes "bet one" button. When the player pushes the "bet one" button, the number of credits shown in the credit display decreases by one, and the number of credits shown in the bet display increases by one. A "max bet" button can also be provided, which enables the player to bet the maximum wager (e.g., max lines, max wager per line, and re-spin operation). The computational device 100 may include other suitable wager buttons, such as a "repeat bet" button (e.g., repeating the bet made from the immediately last play of the computational device 100 for the next play of the computational device 100), one or more "select paylines" buttons, a "select re-spin operation" button, and one or more "select wager per payline" buttons.

Another type of input device 108 that may be provided on the computational device 100 is a physical cash out button, a virtual cash out button, a selectable GUI element, or the like. The player presses a cash out button and cashes-out to receive a cash payment or other suitable form of payment corresponding to the number of remaining credits. The player can receive coins or tokens in a coin payout tray or a ticket or credit slip, which are redeemable by a cashier or funded to the player's electronically-recordable identification card.

The computational device 100 may also include one or more display screens 104 and one or more sound generating devices 136. The combination of outputs provided on a display screen 104 and sound generating device 136 may contribute to the game play experience and, in some embodiments, may provide the player with information regarding a status of a game play event or sequence of events.

In one embodiment, the sound generating device 136 may include at least one speaker or other type of transducer for generating audible sounds, playing music, etc. In one embodiment, a computational device 100 provides dynamic sounds coupled with attractive multimedia images displayed on the display screen 104 to provide an audio-visual representation or to otherwise display full-motion video with sound to attract players to the computational device 100. During idle periods, the computational device 100 displays a sequence of audio and/or visual attraction messages to attract potential players to the computational device 100.

In one embodiment, a base or primary grid-based game includes a slot game with one or more paylines 120. As will be discussed in further detail herein, the grid-based game provided by the computational device 100 may support one or multiple paylines 120, which may extend across the display screen 104 vertically, horizontally, diagonally, at adjusted angles, etc. In some embodiments, such as for a slot game, a payline 120 intersects a plurality of reels 116, such as three to five reels. Each reel 116 of the display screen 104 may be used to display different sets of symbols in connection with game play activity provided by the computational device 100. In some embodiments, each reel 116 may operate independent of all other reels and the symbols displayed by a reel 116 at the end of a given spin may depend upon random numbers generated by the computational device 100. The positions of symbols on each reel 116 and in the combination of reels 116 may form the array of cells in the presentation order rendered to the display screen 104 of the computational device 100.

The reels 116 may be provided in video form with simulated reels being displayed via the display screen 104. A reel 116 may be used to display any number of symbols such as bells, hearts, fruits, numbers, letters, bars or other images and symbols, which preferably correspond to a theme associated with a game provided by the computational device 100. With a slot game, the computational device 100 may be configured to award prizes, awards, or other game play opportunities when the reels 116 stop spinning and a predetermined symbol combination lands across an active payline 120 (e.g., a payline 120 that is currently being wagered and is subject to evaluation for a win after the reels 116 have stopped spinning).

FIG. 1B illustrates another example of a computational device 100 in accordance with at least some embodiments of the present disclosure. This particular example of computational device 100 may correspond to a portable computational device 100 such as a mobile smartphone, tablet, wearable, etc. The computational device 100 may be owned by a user of the device 100 rather than being owned by a casino operator.

The computational device 100 again includes a display screen 104, a plurality of input devices 108, and at least one speaker 136. In some embodiments, the display screen 104 may correspond to a touch-sensitive display screen, meaning that the display screen 104 is simultaneously capable of displaying information (e.g., in connection with game play activity) and receiving a user input. In some embodiments, the touch-sensitive display screen 104 may provide game features similar to a cabinet-style computational device 100 without requiring all of the dedicated buttons provided by a cabinet-style computational device 100.

Figure 2:
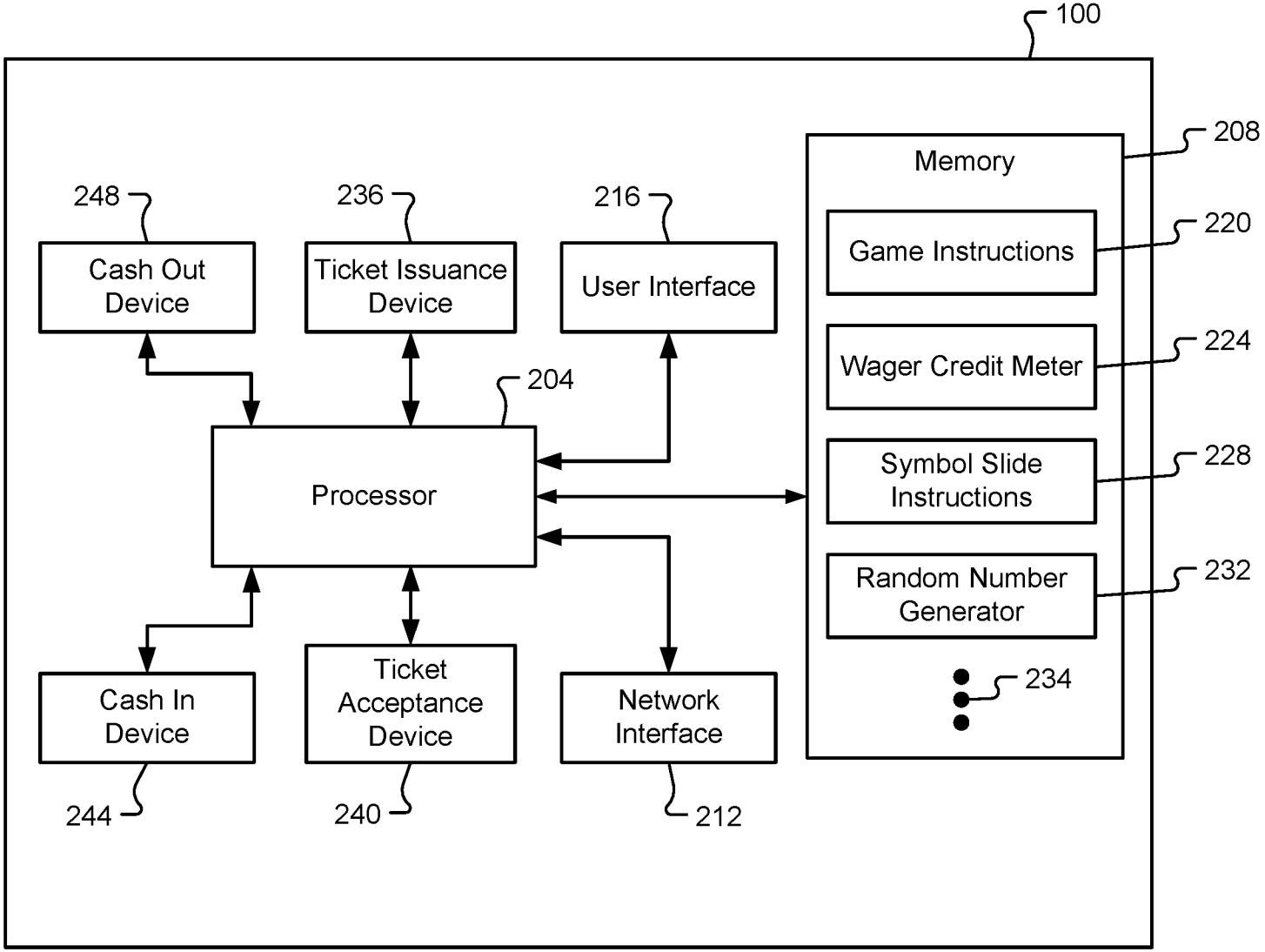
FIG. 2 is a block diagram depicting components of a computational gaming device for enabling enhanced gaming features and sliding symbol operations.

With reference now to FIG. 2, additional details of the components that may be included in a computational device 100 will be described in accordance with at least some embodiments of the present disclosure. The computational device 100 is shown to include a processor 204, memory 208, a network interface 212, and a user interface 216. In some embodiments, the processor 204 may correspond to one or many microprocessors, Central Processing Units (CPUs), microcontrollers, Integrated Circuit (IC) chips, or the like. The processor 204 may be configured to execute one or more instruction sets stored in memory 208. In some embodiments, the instruction sets stored in memory 208, when executed by the processor 204, may enable the computational device 100 to provide game play functionality.

The nature of the network interface 212 may depend upon whether the network interface 212 is provided in cabinet-style computational device 100 or a mobile computational device 100. Examples of a suitable network interface 212 include, without limitation, an Ethernet port, a Universal Serial Bus (USB) port, an RS-232 port, an RS-485 port, a network interface controller (NIC), an antenna, a driver circuit, a modulator/demodulator, etc. The network interface 212 may include one or multiple different network interfaces depending upon whether the computational device 100 is connecting to a single communication network or multiple different types of communication networks. For instance, the computational device 100 may be provided with both a wired network interface 212 and a wireless network interface 212 without departing from the scope of the present disclosure.

The user interface 216 may include a combination of the user input and user outputs described in connection with FIGS. 1A and 1B. For instance, the user interface 216 may include the display screen 104, the input devices 108, the speakers 136, or any other component that is capable of enabling user interaction with the computational device 100. The user interface 216 may also include one or more drivers for the various hardware components that enable user interaction with the computational device 100.

The memory 208 may include one or multiple computer memory devices that are volatile or non-volatile. The memory 208 may be configured to store instruction sets that enable player interaction with the computational device 100 and that enable game play at the computational device 100. Examples of instruction sets that may be stored in the memory 208 include a game instruction set 220, a credit meter 224, and a symbol slide instruction set 228. In addition to the instruction sets, the memory 208 may also be configured to store a random number generator 232 that is used by the game instruction set 220, for example, to provide game outputs.

In some embodiments, the game instruction set 220, when executed by the processor 204, may enable the computational device 100 to facilitate one or more games of chance or skill and produce interactions between the player and the game of chance or skill. In some embodiments, the game instruction set 220 may include subroutines that present one or more graphics to the player via the user interface 216, subroutines that calculate whether a particular wager has resulted in a win or loss during the game of chance or skill, subroutines for determining payouts for the player in the event of a win, subroutines for exchanging communications with another device, such as a server, subroutines for determining random slidable symbol appearances during game play, and any other subroutine useful in connection with facilitating game play at the computational device 100.

In some embodiments, the game instruction set 220 may include instructions that initiate a reel spin at the various reels 116 in connection with game play. In some embodiments, the random number generator 232 is used to determine a final position of the reels 116 after the spin is completed. The game instruction set 220 may also be configured to present symbols via the display screen 104 when the reels 116 correspond to video reels or the like. The game instruction set 220 may also be configured to evaluate a position of symbols relative to one or more paylines 120, relative to predetermined symbol areas, or cells in an array of cells, and any other evaluation desired to facilitate game play.

The credit meter 224 may correspond to an instruction set within the computational device 100 that facilitates a tracking of wager activity at the computational device 100. In some embodiments, the credit meter 224 may be used to store or log information related to various player activities and events that occur at the computational device 100. The types of information that may be maintained in the credit meter 224 include, without limitation, player information, available credit information, wager amount information, and other types of information that may or may not need to be recorded for purposes of accounting for wagers placed at the computational device 100 and payouts made for a player during a game of chance or skill played at the computational device 100.

In some embodiments, the credit meter 224 may be configured to track coin in activity, coin out activity, coin drop activity, jackpot paid activity, credits applied activity, external bonus payout activity, voucher in activity, voucher out activity, timing of events that occur at the computational device 100, and the like. In some embodiments, certain portions of the credit meter 224 may be updated in response to outcomes of a game of chance or skill played at the computational device 100.

The symbol slide instruction set 228 may correspond to a subroutine that is called by the game instruction set 220 during game play. In some embodiments, the symbol slide instruction set 228 may be called by the game instruction set 220 when the game instruction set determines that a sliding symbol operation is available and/or that a particular symbol in the array of cells is assigned as a slidable symbol. In some embodiments, the symbol slide instruction set 228 is configured, when executed by the processor 204, to prompt a player for a movement of an identified slidable symbol (e.g., identifying the slidable symbol with an identifying mark, etc.) that the player may wish to be maintained in a different cell location during a subsequent game play (e.g., a re-spin operation). The symbol slide instruction set 228 may further receive the user input (e.g., by the player selecting the identified slidable symbol in a first cell and providing a "dragging" movement to another cell in the array of cells) that moves the slidable symbol to the desired cell location in the array of cells, where the slidable symbol is maintained for the subsequent game play. In response, the symbol slide instruction set 228 may inform the game instruction set 220 of the slidable symbol to lock during the subsequent game play (e.g., re-spin operation, etc.). The game instruction set 220 can then implement a re-spin operation while maintaining the slidable symbol in the dragged-to cell chosen by the player and received by the symbol slide instruction set 228. The symbol slide instruction set 228 may be configured to identify which symbol in the array of cells is eligible to be moved (e.g., slid) and then maintained during a subsequent play or, conversely, which symbol in the array of cells is ineligible from being moved and then maintained during the subsequent play. It is the cooperation of the game instruction set 220 and symbol slide instruction set 228 that helps increase the desirability of the overall gaming experience and that gives a player the sense of control over the game that may increase their desire to continue playing the computational device 100.

While shown as separate instruction sets, it should be appreciated that the symbol slide instruction set 228 may correspond to a subroutine of the game instruction set 220 without departing from the scope of the present disclosure. Additional details and functional capabilities of the symbol slide instruction set 228 working in cooperation with the game instruction set 220 will be described in connection with FIGS. 3-5B.

The computational device 100 is further shown to include a ticket issuance device 236, a ticket acceptance device 240, a cash in device 244, and a cash out device 238. The ticket issuance device 236 may be configured to receive physical tickets, vouchers, or player loyalty cards. In some embodiments, the ticket issuance device 236 and ticket acceptance device 240 may operate in concert with the ticket acceptor 128. In such an embodiment, the ticket acceptor 128 may correspond to the physical components that receive and issue a ticket or voucher whereas the ticket issuance device 236 and the ticket acceptance device 240 correspond to the drivers and/or firmware components that control operation of the ticket acceptor 128. It should also be appreciated that the card reader 132 may be in communication with the ticket issuance device 236 and the ticket acceptance device 140 and may have functionality driven by one or both of these devices. For instance, the card reader 132 may correspond to the physical hardware components that receive information from a player loyalty card (or player loyalty application running on a mobile communication device, etc.) and that information may be processed by the ticket acceptance device 240 when receiving player credits from cards read by the card reader 132. The ticket issuance device 236 may provide the card reader 132 with information for applying wager credits back to a player card when a player is done with a game play session and wishes to transfer credits from the credit meter 224 back onto their card. Thus, the ticket issuance device 236 and ticket acceptance device 240 may also operate as a driver and/or firmware component for the card reader 132.

Similarly, the cash in device 244 and cash out device 248 may include or operate in concert with the coin slot 124 and any coin delivery mechanisms. The cash in device 244 and cash out device 248 may include hardware, drivers, or firmware that facilitate receiving or distributing cash, tokens, bills, etc. In some embodiments, the cash in device 244 may be configured to determine an amount of cash (e.g., in coins, bills, etc.), an amount or number of tokens, etc., input at the coin slot 124 and convert the values into credits for playing games with the game instruction set 220. The cash out device 248 may correspond to hardware and software configured to output coins, tokens, bills, etc. if a player decides to cash out or convert playing credits back into cash, tokens, bills, etc.

Figure 3:
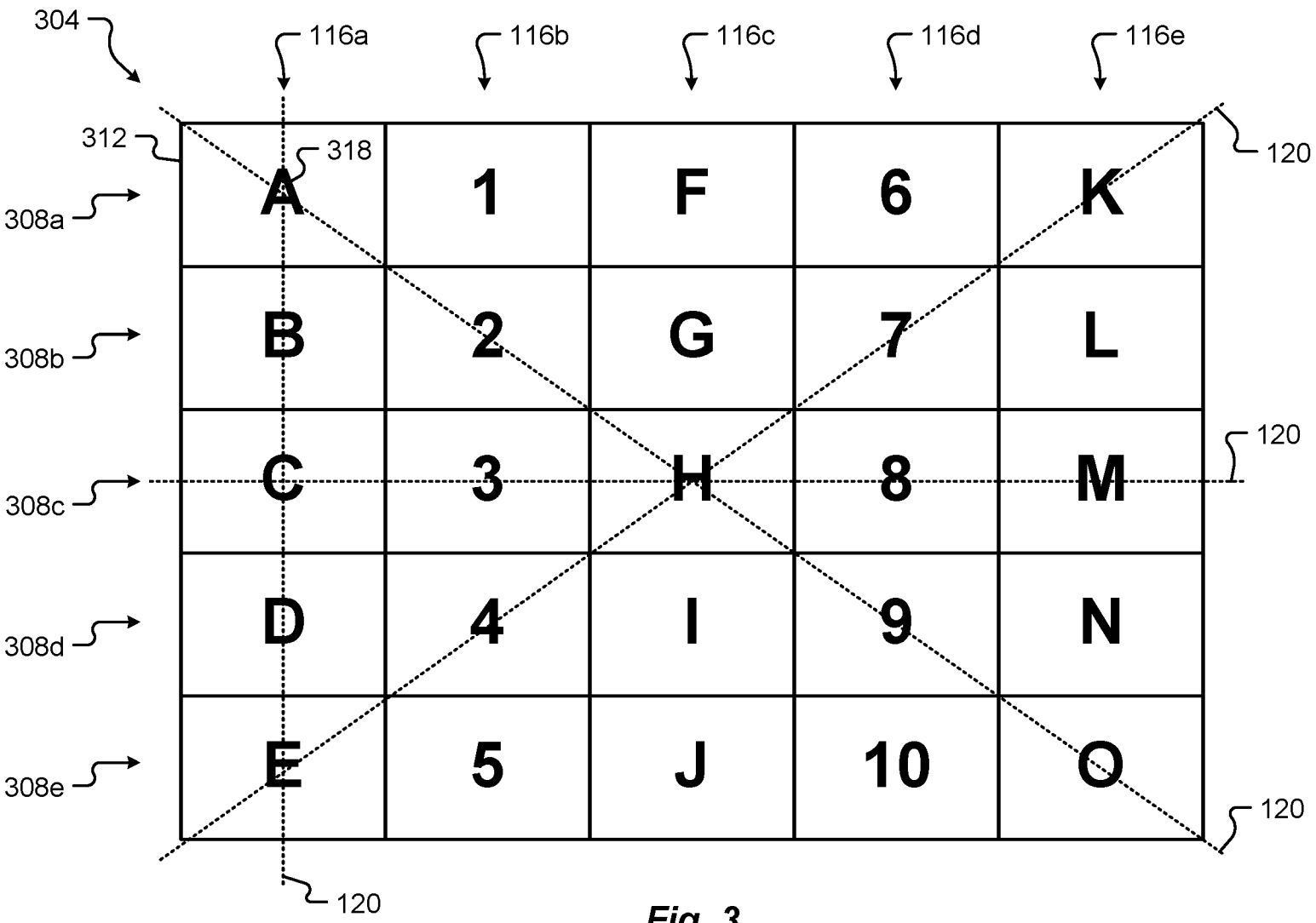
FIG. 3 is an illustrative layout of symbols rendered to an array of cells of a grid-based game.

With reference now to FIGS. 3 to 5B, various operations of the game instruction set 220 and the symbol slide instruction set 228 will be described in accordance with at least some embodiments of the present disclosure. Referring initially to FIG. 3, a first layout of symbols 318 rendered to an array of cells 304 of a grid-based game will be described in accordance with embodiments of the present disclosure. The array of cells 304 may be presented, or otherwise rendered, with the display screen 104. In some embodiments, the game instruction set 220 may control which particular symbols 318 are presented within a particular cell 312 in the array of cells 304. The illustrative array of cells 304 is shown to include five columns 116*a*, 116*b*, 116*c*, 116*d*, 116*e* of cells 312 and five rows 308*a*, 308*b*, 308*c*, 308*d*, 308*e* of cells 312. Although FIG. 3 illustrates a 5×5 array of cells 304, it should be appreciated that embodiments of the present disclosure can be implemented in an array of cells 304 having a variety of sizes. For instance, embodiments of the present disclosure may be used in an array of cells 304 that are 3×3, 3×5, 5×3, 7×3, 10×5, 10×10, etc. The example layout of the array of cells 304 should not be construed as limiting embodiments of the present disclosure.

As can be seen in FIG. 3, each cell 312 in the array of cells 304 may be populated with a single symbol 318. In other words, after the game instruction set 220 has applied a random number generator 232 to determine symbol 318 placement throughout the array of cells 304, there will be a 1:1 correlation of symbols 318 to cells 312. Each column 116*a*, 116*b*, 116*c*, 116*d*, 116*e* may also be referred to as a reel 116, particularly in the event that the game instruction set 220 provides a slot game. If a slot game is implemented, then the reels 116 (e.g., in video form) are spun (e.g., virtually) and their final position after the spin is determined, at least in part, with assistance of the random number generator 232. In some embodiments, a symbol 318 may correspond to an absence of a symbol or a blank symbol. This blank symbol may correspond to a symbol in a cell 312 having no value.

In some embodiments, payouts or other predetermined game outcomes (e.g., bonus spin opportunities, prize wins, cash wins, re-spin bonus plays, etc.) may be determined based on a symbol combination that falls on a payline 120 that was subject to a wager prior to the spin. In some embodiments, a plurality of the paylines 120 may be selected for "play" prior to a spin, meaning that any payline 120 selected for "play" will be evaluated for a predetermined symbol combination, or sequence of symbols 318. Examples of a sequence of symbols 318 may include, but are in no way limited to, at least one of the sequence [A; 1; F; 6; K] associated with the first row 308*a*, the sequence [B; 2; G; 7; L] associated with the second row 308*b*, the sequence [C; 3; H; 8; M] associated with the third row 308*c*, the sequence [D; 4; I; 9; N] associated with the fourth row 308*d*, the sequence [E; 5; J; 10; O] associated with the fifth row 308*e*, and/or reverse sequences of the same. Additionally or alternatively, the sequence of symbols 318 may include, but are in no way limited to, a sequence of symbols 318 in an order along one or more of the vertical lines of cells 312 associated with the columns 116*a*-116*e* (e.g., the sequence [A; B; C; D; E], the sequence [1; 2; 3; 4; 5], etc., and/or reverse sequences of the same). In some embodiments, the sequence of symbols 318 may include, but are in no way limited to, a sequence of symbols 318 in an order along one or more of the cells 312 having a payline 120 running therethrough (e.g., the first diagonal payline sequence [A; 2; H; 9; O], the second diagonal payline sequence [E; 4; H; 7; K], the first vertical payline sequence [A; B; C; D; E], the first horizontal payline sequence [C; 3; H; 8; M], etc., and/or reverse sequences of the same). In one embodiment, the sequence of symbols may comprise all sequences of symbols associated with each row 308*a*-308*e* and/or column 116*a*-116*e*. A selected payline 120 may also correspond to the payline 120 that is evaluated after symbols 318 have been subjected to a sliding symbol operation by the symbol slide instruction set 228. In some embodiments, however, it may be possible to switch or select more paylines 120 for evaluation after a spin has completed, but before a subsequent play operation (e.g., re-spin, etc.) has been performed. The addition of more paylines 120 after the original spin but prior to the subsequent play operation may require the user to provide more credits to the game instruction set 220 as part of enabling evaluation over more paylines 120. Although shown having four different linear paylines 120 (e.g., horizontal, vertical, diagonal, etc.), one or more paylines 120 may be associated with cells 312 in any shape the array of cells 304. In one embodiment, a payline 120 may run through a single row 308*a*-308*e* of the array of cells 304 (e.g., first row 308*a*, etc.). In some embodiments, a payline 120 may run through one or more columns 116*a*-116*e* in the array of cells 304. In any event, embodiments of the present disclosure are not limited to the position and/or shape of the paylines 120 shown in FIGS. 3-5B.

Referring now to FIGS. 4A-4E, an illustrative game play sequence that can be performed by the game instruction set 220 and the symbol slide instruction set 228 will be described in accordance with at least some embodiments of the present disclosure. In some embodiments, FIGS. 4A-4E illustrate various presentations that are caused to be rendered by a display screen 104 of a computational device 100.

Figure 4A:
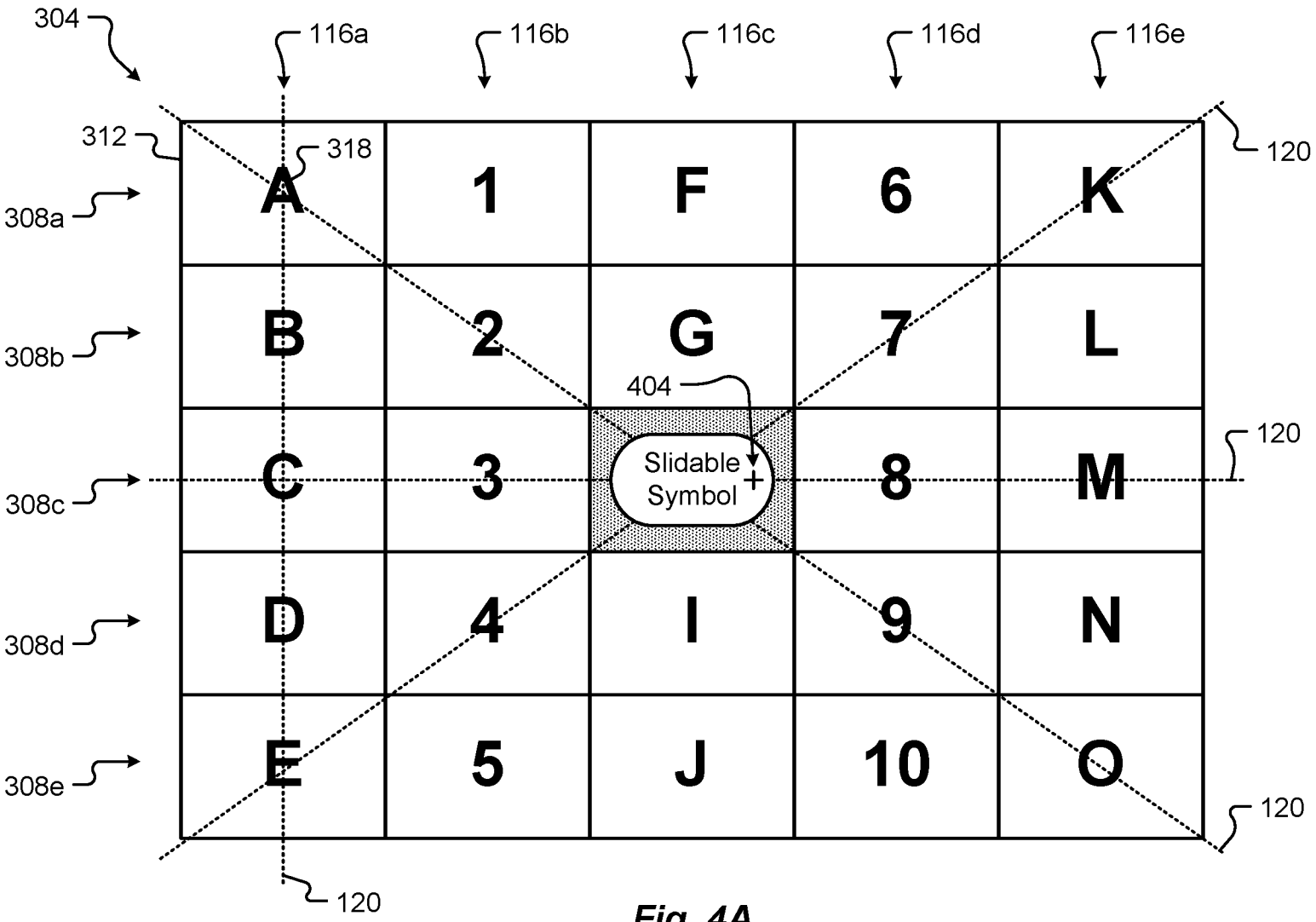
FIG. 4A illustrates a first output of the computational gaming device showing a first sequence of symbols comprising a slidable symbol feature associated with a particular symbol in the array of cells that are rendered as a result of a play of the grid-based game.

In the example of FIG. 4A, a slidable symbol is shown to have landed in a symbol area 312. Specifically, the slidable symbol is shown to have landed in the symbol area 312 that resides at the intersection of the third row 308*c* and the third column 116*c*. The original play, or spin, and placement of symbols 318 throughout the array of cells 304 may have been determined by the game instruction set 220 working in cooperation with the random number generator 232. Stated another way, each cell 312 in the array of cells 304 is populated with a respective discrete symbol 318 that is rendered by the display screen 104 of the computational device 100. The symbols 318 may be randomly assigned to each cell 312 in the array of cells 304. The position of symbols 318 in the array of cells 304 may be evaluated by the game instruction set 220 to determine if a predetermined game outcome has occurred (e.g., a wager has resulted in a win or prize, a slidable symbol is available, etc.). For instance, the game instruction set 220 may determine if a sequence of symbols 318 along a payline 120 corresponds to a winning game outcome, etc. The sequence of symbols 318 may correspond to an order of symbols 318 in a particular sequence as defined by the rules of the game. In one embodiment, a winning outcome for a sequence of symbols 318 may require at least one of a first symbol to appear in the first column 116*a* of a payline 120, a second symbol to appear in the second column 116*b* of the same payline 120, a third symbol to appear in the third column 116*c* of the same payline 120, a fourth symbol to appear in the fourth column 116*d* of the same payline 120, and a fifth symbol to appear in the fifth column 116*e* of the same payline. Depending on the rules of the game, these symbols 318 may be required to be the same, for example, forming a match between two or more cells 312 in the sequence of symbols 318.

In FIG. 4A, the game instruction set 220 and/or the symbol slide instruction set 228 in conjunction with the random number generator 232 randomly generated a slidable symbol associated with a particular symbol 318 in the cell 312 at the intersection of the third row 308*c* and the third column 116*c*. In some embodiments, the slidable symbol may be made available in response to a previous game play, a wager amount, a historical game play, etc. The placement and position, or cell 312, associated with the slidable symbol in the array of cells 304 may be randomly determined (e.g., via the game instruction set 220 and/or the symbol slide instruction set 228 executing instructions in conjunction with the random number generator 232). As provided above, the type of the slidable symbol may correspond to any type of particular symbol 318 used in the game. In one embodiment, the slidable symbol may correspond to a bonus symbol type, a high-probability winning symbol type (e.g., cherries, diamonds, multipliers, etc.), and/or some other symbol that may increase the player's chances of winning on a subsequent play where the slidable symbol is maintained in a particular cell 312 in the array of cells 304.

As shown in FIG. 4A, the slidable symbol may be rendered to the display screen 104 along with an identifying mark 404. Shown as crosshairs, or a "plus" symbol, the identifying mark 404 may indicate to a player that the slidable symbol can be moved, or slid, to another cell 312 in the array of cells 304. In one embodiment, a player may interact with the identifying mark 404 (e.g., by selecting the slidable symbol for movement by touching, or clicking, on the identifying mark 404) to move the slidable symbol to another cell 312. The identifying mark 404 may be represented as a highlight, an underscore, an animated region of the cell 312 housing the slidable symbol, an animated icon, any other icon, etc., and/or combinations thereof.

Figure 4B:
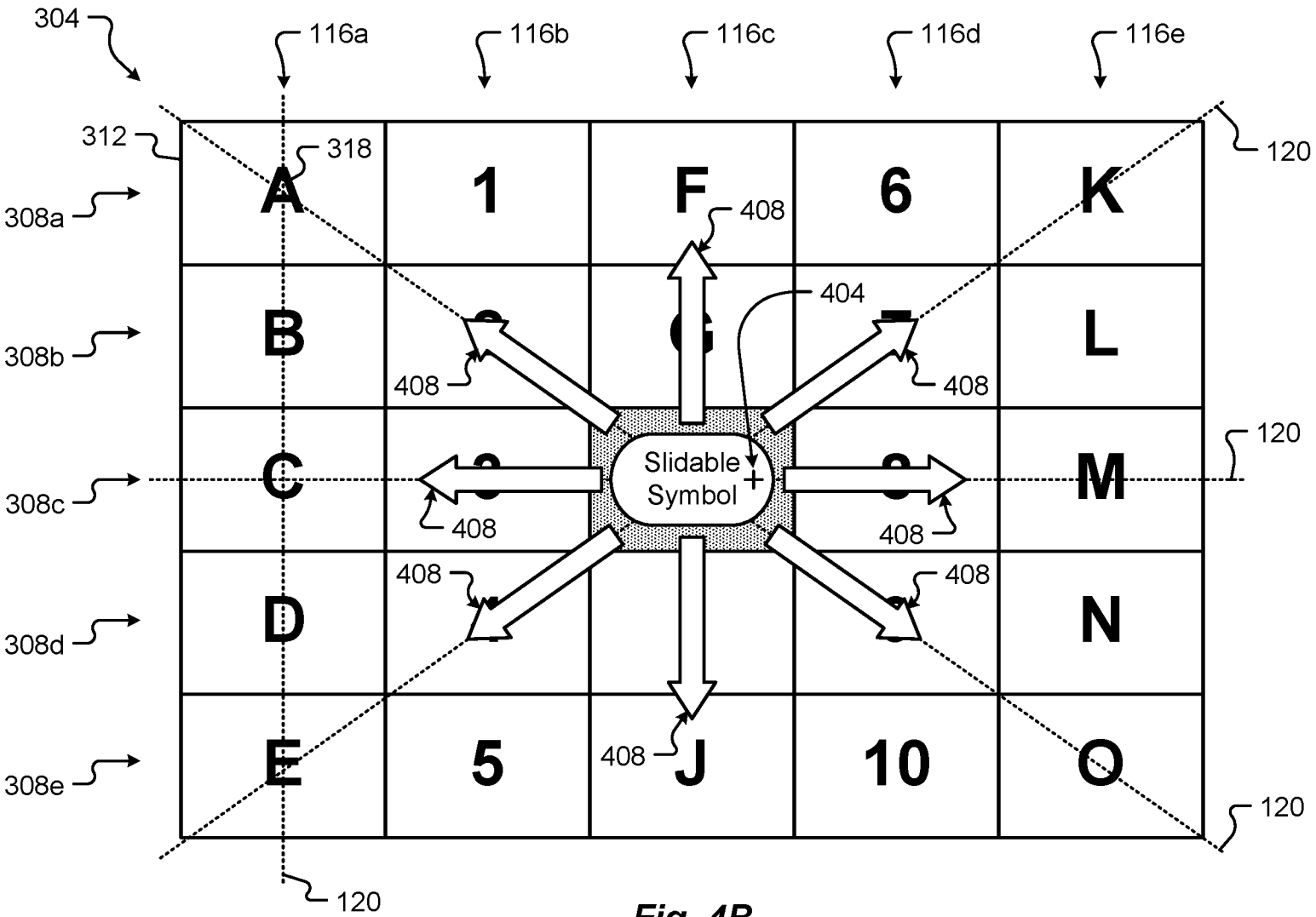
FIG. 4B illustrates a second output of the computational gaming device showing movement options for the particular symbol along lines of the array of cells.

In response to the player interacting with the slidable symbol and/or the identifying mark 404 associated with the slidable symbol (e.g., by touching, clicking, etc., at an input device 108 or other user interface), a second output or presentation, as shown in FIG. 4B, may be displayed by the display screen 104 showing movement (e.g., sliding, etc.) options for the slidable symbol. These movement options for the slidable symbol are shown by the movement direction arrows 408 extending outwardly and away from the slidable symbol in the array of cells 304. Depending on the rules of the game, the movement direction arrow 408 may define available movement options and/or movement restrictions for the slidable symbol. For instance, in one set of rules, the slidable symbol may only be moved from the cell 312 in which it first appeared along a column 116*a*-116*e* or along a row 308*a*-308*e* to another cell 312 in the same column 116*a*-116*e* or in the same row 308*a*-308*e*, respectively. In some embodiments, the slidable symbol may only be moved from the cell 312 in which it first appeared along a payline 120 to another cell 312 running through the same payline 120.

As illustrated in FIG. 4B, the slidable symbol may be moved horizontally along the payline 120 associated with the third row 308*c* along a direction to the left-hand side or the right-hand side of the cell 312 in which the slidable symbol first appeared. By way of example, the slidable symbol may be moved (e.g., slid, dragged, etc.) from the cell 312 at the intersection of the third row 308*c* and the third column 116*c* to one of the cell 312 at the intersection of the third row 308*c* and the first column 116*a* (e.g., the furthest left position in the presentation order), the cell 312 at the intersection of the third row 308*c* and the second column 116*b* (e.g., the second position from the furthest left position in the presentation order), the cell 312 at the intersection of the third row 308*c* and the fifth column 116*e* (e.g., the furthest right position in the presentation order), and the cell 312 at the intersection of the third row 308*c* and the fourth column 116*d* (the second position from the furthest right position in the presentation order).

In some embodiments, the slidable symbol may be moved vertically along the third column 116*c* along a direction to the top side or the bottom side of the cell 312 in which the slidable symbol first appeared. For example, the slidable symbol may be moved from the cell 312 at the intersection of the third row 308*c* and the third column 116*c* to one of the cell 312 at the intersection of the first row 308*a* and the third column 116*c* (e.g., the uppermost position in the columnar presentation order), the cell 312 at the intersection of the second row 308*b* and the third column 116*c* (e.g., the second position from the uppermost position in the columnar presentation order), the cell 312 at the intersection of the fifth row 308*e* and the third column 116*c* (e.g., the bottommost position in the columnar presentation order), and the cell 312 at the intersection of the second row 308*b* and the third column 116*c* (the second position from the bottommost position in the columnar presentation order).

In one embodiment, the slidable symbol may be moved diagonally from the cell 312 in which the slidable symbol first appeared to a cell 312 that runs along the payline 120 running from the cell 312 at the intersection of the first row 308*a* and the first column 116*a* to the cell 312 at the intersection of the fifth row 308*e* and the fifth column 116*e*. Additionally or alternatively, the slidable symbol may be moved diagonally from the cell 312 in which the slidable symbol first appeared to a cell 312 that runs along the payline 120 running from the cell 312 at the intersection of the fifth row 308*e* and the first column 116*a* to the cell 312 at the intersection of the first row 308*a* and the fifth column 116*e*.

In some embodiments, the array of cells 304 may only include a single row 308*c* of cells 312 making up the array of cells 304. In this example, the movement direction arrows 408 may indicate that movement of the slidable symbol is only available along a horizontal direction to a cell 312 that runs along a line in the horizontal direction. Alternatively, the array of cells 304 may only include a single column 116*c* of cells 312 making up the array of cells 304. In this alternative example, the movement direction arrows 408 may indicate that movement of the slidable symbol is only available along a vertical direction to a cell 312 that runs along a line in the vertical direction.

Figure 4C:
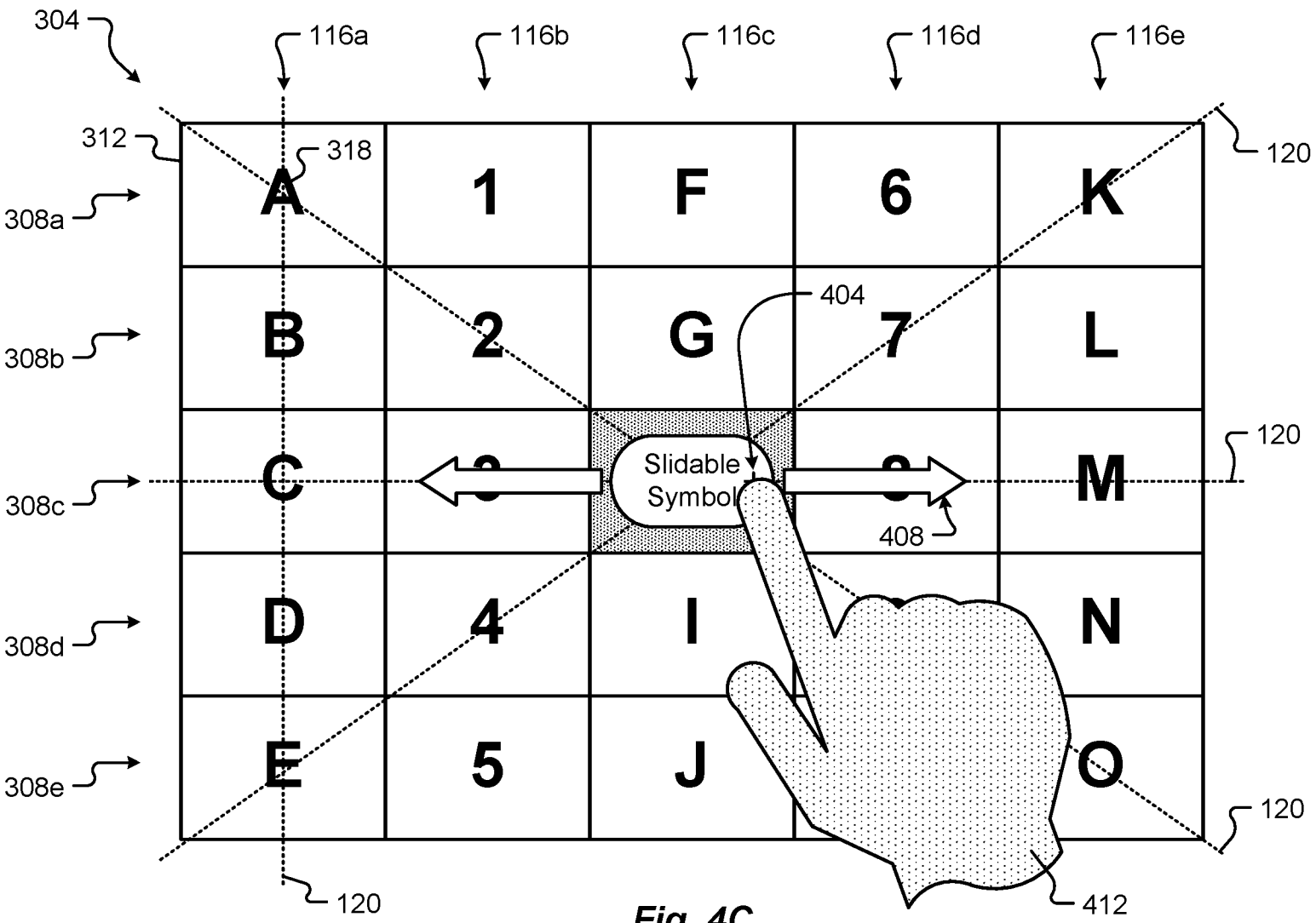
FIG. 4C illustrates a third output of the computational gaming device showing the particular symbol being dragged along a first line of the array of cells.

In the third output, or presentation, shown in FIG. 4C, the movement direction arrows 408 indicate that the slidable symbol may be moved horizontally (e.g., along the payline 120 running through the third row 308*c*). This presentation may be made in response to determining that the player has imparted a horizontal drag, or slide, movement via a player interface element 412. The player interface element 412 may correspond to a hand (or portion thereof) of a player, a stylus used by a player, and/or a virtual representation of a hand (or portion thereof) of a player rendered to the display screen 104. In any event, when the player interacts with the slidable symbol and/or the identifying mark 404 associated with the slidable symbol by sliding the slidable symbol in a horizontal direction, the movement direction arrows 408 may only show the movement direction arrow 408 extending toward the left and the movement direction arrow 408 extending toward the right of the array of cells 304.

Figure 4D:
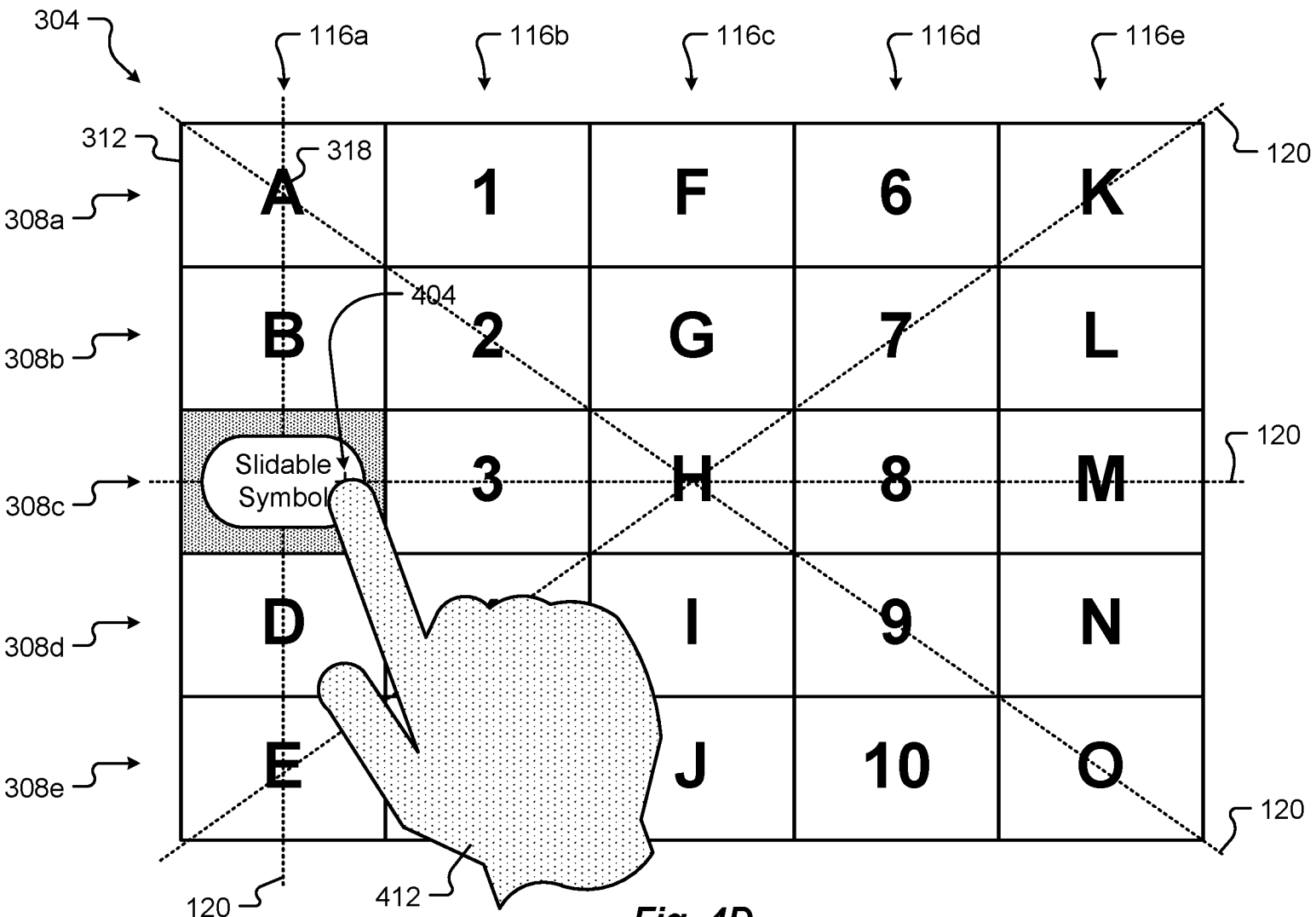
FIG. 4D illustrates a fourth output of the computational gaming device showing the particular symbol being dragged to a higher priority cell position of the array of cells.

Continuing the sliding movement input provided by the player in FIG. 4C, FIG. 4D shows a position of the slidable symbol when the slidable symbol has been dragged to the cell 312 at the intersection of the first column 116*a* and the third row 308*c*. When a slidable symbol has been dragged from one cell 312 to another, the type of the symbol 318 associated with the slidable symbol remains the same as when it first appeared for at least one subsequent paid-for play. By way of example, if the type of the symbol 318 that first appeared in the cell 312 at the intersection of the third column 116*c* and the third row 308*c* was a "cherry," then the type of the symbol 318 that is dragged to the intersection of the first column 116*a* and the third row 308*c* would be maintained as a "cherry." Among other things, this slidable-manipulability allows a player to setup a line, or sequence, of symbols 318 with a particular symbol dragged to a player-selected cell 312 and/or position in the presentation order of the array of cells 304 and alter at least one of a proposed payout amount and the players chances of winning in a subsequent, or next, play. For the next play, in this example, the slidable symbol dragged to the intersection of the first column 116*a* and the third row 308*c* would be maintained as a "cherry," while the other symbols 318 in the array of cells 304 may be recalculated (e.g., via the game instruction set 220 and/or the symbol slide instruction set 228 working with the random number generator 232) and rendered to the other cells 312 in array of cells 304 (e.g., other than the cell 312 at the intersection of the first column 116*a* and the third row 308*c*).

In some embodiments, the position of the cell 312 to which the slidable symbol was dragged in the presentation order of the array of cells 304 may determine whether a behavior of the game should be altered. Game behavior may include proposed payout amounts, odds or chances of winning, subsequent number of plays where the slidable symbol is maintained in a particular position, additional wagers required, etc. For example, in reel-spin, or slot, games, each reel 116 in the array of cells 304 may be associated with a particular priority. The first column 116*a* in a reel-spin game typically has a first priority, the second column 116*b* has a second priority, the third column 116*c* has a third priority, the fourth column 116*d* has a fourth priority, and the fifth column 116*e* has a fifth priority. These priorities may be ordered, from the first priority to the fifth priority, in order from the highest priority to the lowest priority. When a particular symbol 318 lands in a cell 312 having the first priority, the chances of obtaining a winning sequence of symbols 318 as the game outcome increases (e.g., the probability of winning becomes better). Additionally or alternatively, when a particular symbol 318 lands in a cell 312 having the fifth priority, the chances of obtaining a winning sequence of symbols 318 as the game outcome decreases (e.g., the probability of winning becomes worse). In some embodiments, however, a player may be incentivized to move from a cell 312 having a higher priority to a cell 312 having a lower priority to at least one of increase a potential payout amount, maintain the slidable symbol in the cell having the lower priority for a greater number of plays (e.g., spins), and have the opportunity to gain an additional slidable symbol in the next play, etc.

Figure 4E:
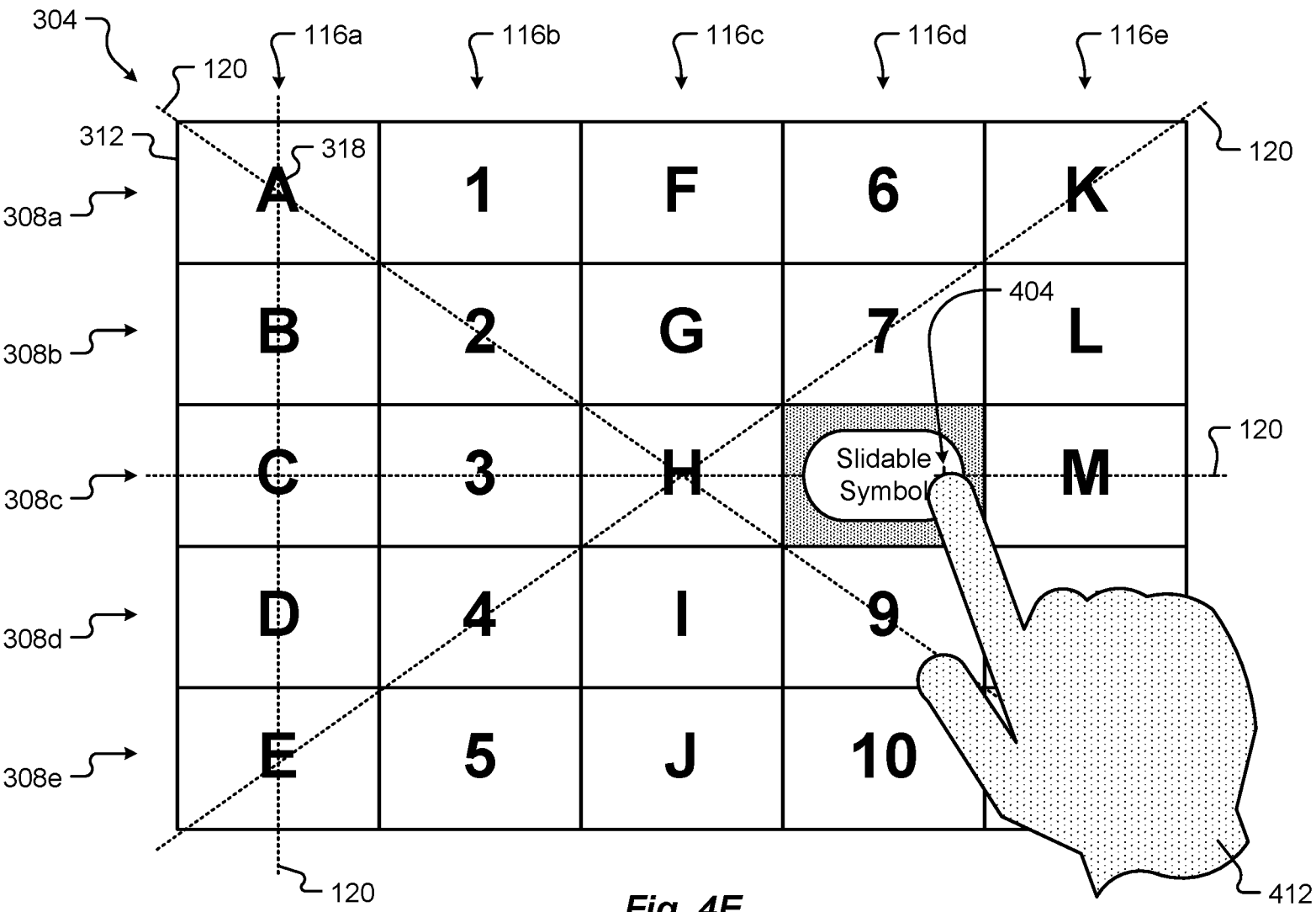
FIG. 4E illustrates a fifth output of the computational gaming device showing the particular symbol being dragged to a lower priority cell position in the array of cells.

In one embodiment, and by continuing the sliding movement input first provided by the player in FIG. 4C, FIG. 4E shows a position of the slidable symbol when the slidable symbol has been dragged to the cell 312 at the intersection of the fourth column 116*d* and the third row 308*c*. As described above, this movement of the slidable symbol, from the cell 312 at the intersection of the third column 116*c* and the third row 308*c* to the cell 312 at the intersection of the fourth column 116*d* and the third row 308*c*, may correspond to a movement from a cell 312 having a higher priority (e.g., the third priority) to a cell 312 having a lower priority (e.g., the fourth priority).

Figure 5A:
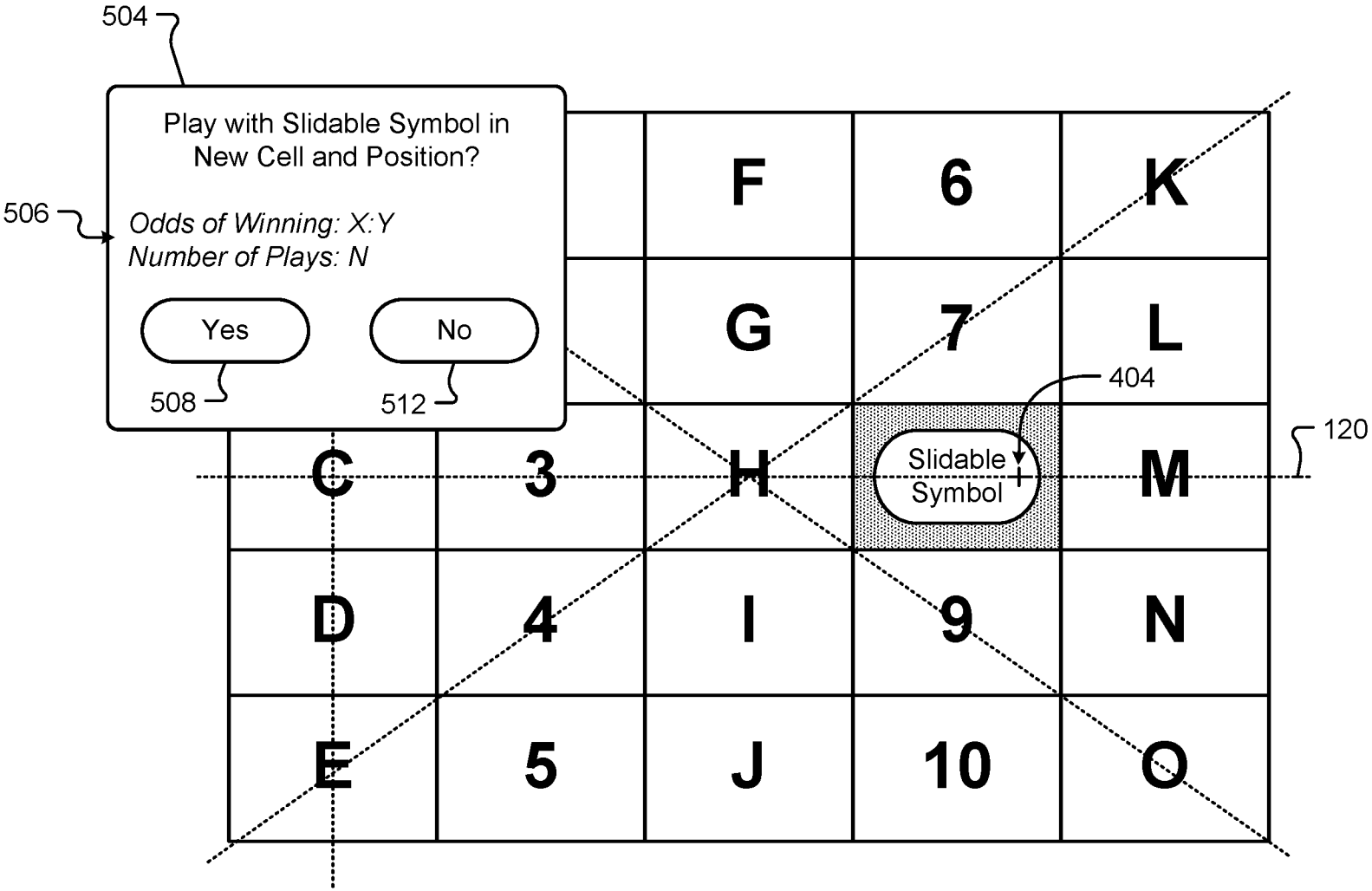
FIG. 5A illustrates a sixth output of the computational gaming device showing a pop-up window comprising subsequent play information and a user prompt rendered in response to moving the particular symbol to a different cell in the array of cells.

When a player has dragged and dropped (e.g., released) the slidable symbol to a selected and available cell 312 in the array of cells 304, a pop-up window 504 may be presented to the player as shown in FIG. 5A. The pop-up window 504 may include a "yes" icon 508 and "no" icon 512 that are user-selectable icons. As can be appreciated, the desire of a player to initiate a subsequent play with the slidable symbol maintained in the player-selected cell 312 may be determined based on the player's response to the pop-up window 504. More specifically, if the player selects the "yes" icon 508, then the game instruction set 220 may call the symbol slide instruction set 228 whereas if the player selects the "no" icon 512, then the game instruction set 220 may continue operating without calling the symbol slide instruction set 228. In some embodiments, the pop-up window 504 may include a subsequent play information area 506. the subsequent play information area 506 may include information associated with the next, or subsequent, play should the slidable symbol be maintained in the player-selected cell 312. This information may include subsequent play information comprising odds of obtaining a winning sequence of symbols 318 in the next play based on the position of the slidable symbol in the sequence of symbols in the presentation order. In one embodiment, the subsequent play information area 506 may comprise information about how many plays, or spins, can be made while the slidable symbol is maintained in the player-selected position. In some embodiments, if a player selects the "no" icon 512, the player may be presented with the option of repositioning, or sliding, the slidable symbol to a new cell location for the next play. The pop-up window 504, or at least a portion thereof, may be presented to a player as the player slides the slidable symbol and hovers over the cells 312 in the array of cells 304. In this manner, the player may be able to observe the information rendered to the subsequent play information area 506 and determine any benefits of moving from one position to another before committing to a particular cell 312.

Figure 5B:
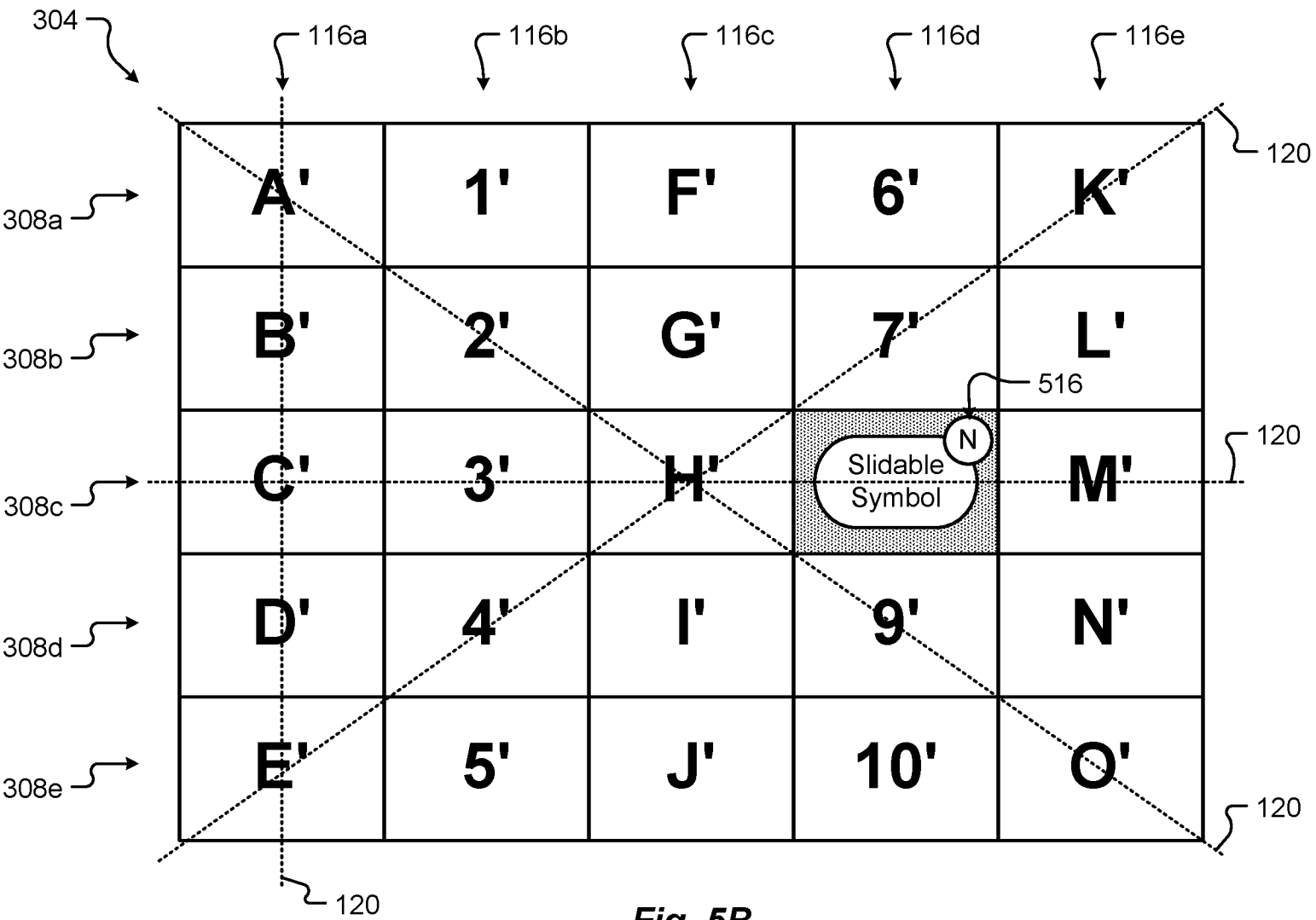
FIG. 5B illustrates a seventh output of the computational gaming device showing the particular symbol maintained in the different cell and a second sequence of symbols in the array of cells that are rendered as a result of a subsequent play of the grid-based game.

In FIG. 5B, a presentation is shown where the player has selected the "yes" icon 508 (e.g., described in conjunction with FIG. 5A, etc.) and/or otherwise confirmed that the player wishes to maintain the slidable symbol in the dragged-to position of the cell 312 at the intersection of the fourth column 116*d* and the third row 308*c* and the subsequent play operation has been initiated. Specifically, FIG. 5B illustrates the array of cells 304 after the subsequent play operation has concluded. As can be seen in FIG. 5B, the slidable symbol at the intersection of the fourth column 116*d* and the third row 308*c*, which was previously selected by the player as the new position for the slidable symbol, is maintained (e.g., keeping the same type of the symbol 318 as was associated with the slidable symbol in the previous play but in a different cell 312 in the array of cells 304) whereas, after the subsequent play, the other symbol cells 312 may have new symbols 318 provided therein. The symbols 318 that populate the symbol cells 312, other than the position of the cell 312 associated with the slidable symbol, were not maintained and may be determined, at least in part, based on an output of the random number generator 232.

In some embodiments, the cell 312 associated with the slidable symbol may include a plays-remaining identifier 516. The plays-remaining identifier 516 is shown as a circle encompassing a number represented by the letter "N" but may be represented in any form that indicates at least one more play with the slidable symbol remains. As provided above a player may pay for, or otherwise obtain, a number of additional plays for which the slidable symbol may be maintained in a player-selected cell 312. This number of additional plays, or the number of plays remaining, may be indicated by the plays-remaining identifier 516. If a player has three subsequent plays in which the slidable symbol will be maintained in the dragged-to cell 312, the plays-remaining identifier 516 may include a number "3" inside the circle rendered to the cell 312. After one of these subsequent plays, the number "3" would decrement by one, such that a "2" would be rendered inside the circle of the plays-remaining identifier 516. In some embodiments, a player may increase a wager, pay for additional plays with the slidable symbol, and/or move the slidable symbol to a lower priority position in the columns or sequence of symbols 318 to increase the number of plays remaining.

Figure 6:
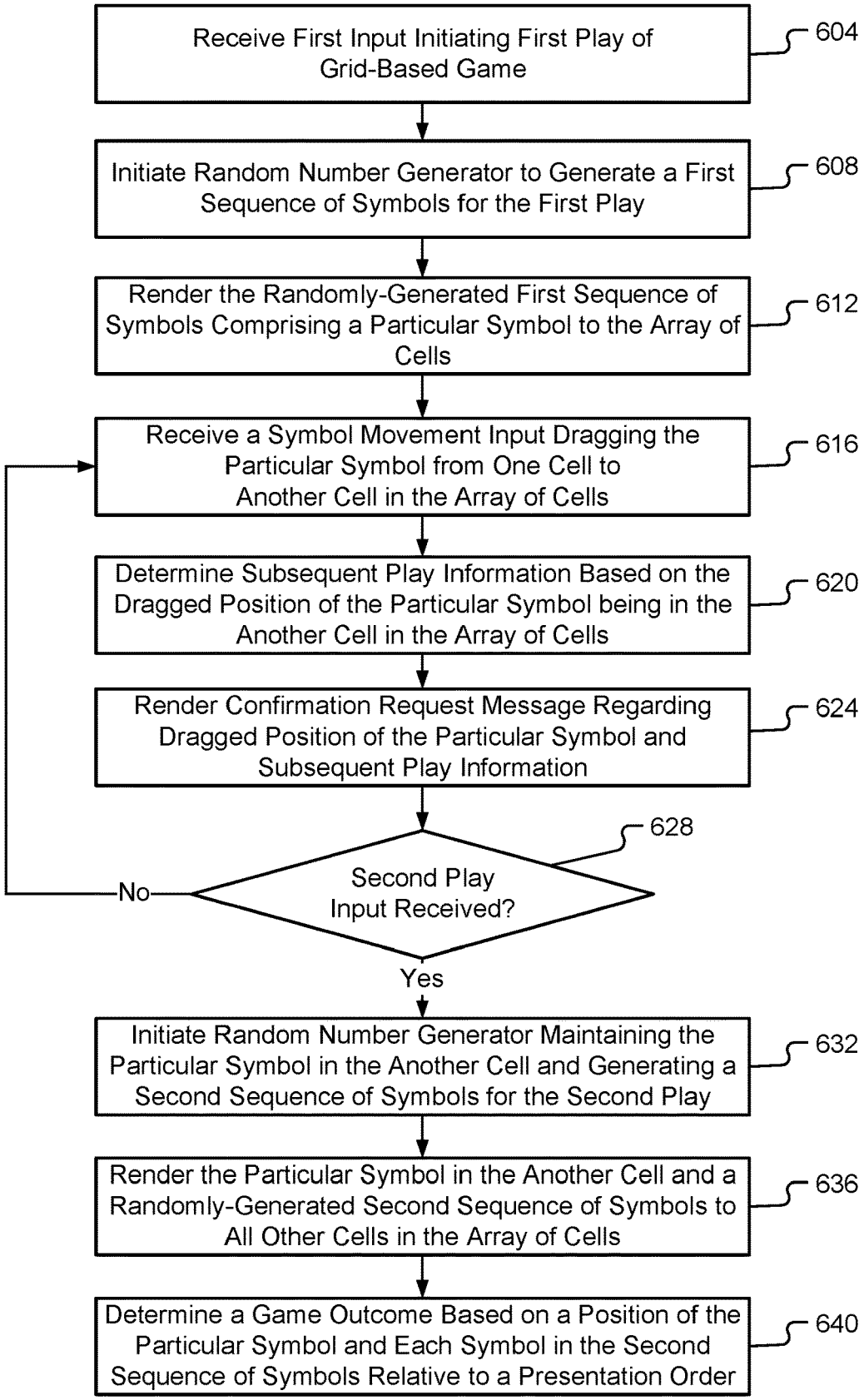
FIG. 6 is a flow diagram of an example process for enabling a sliding symbol operation in a grid-based game.

With reference now to FIG. 6, a flow diagram depicting a method of an example process for enabling a sliding symbol operation in a grid-based game is shown in accordance with embodiments of the present disclosure. The methods described herein may be run as a set of instructions on a computational device 100 and/or some other server in communication with the computational device 100. In some embodiments, the set of instructions may be part of an application installed on the computational device 100. In any event, the method begins by receiving a first input initiating a first play of a grid-based game (step 604). This step may occur in response to the player selecting a predetermined button or providing an input via some other input device 108, inserting coins, cash, tickets, vouchers, etc., or performing some other action at the computational device 100 that indicates a desire to begin game play. In one embodiment, the first input may correspond to an input provided by the player via an input device 108. For example, the first input may correspond to a button press, a touch of a screen, a lever actuation, a gesture, and/or some other physical input provided by the player. The grid-based game may correspond to a reel-spin game, a matching game, and/or any other game having a sequence of symbols 318 arranged in a presentation order.

In response to receiving the first input, the method continues by generating a first sequence of symbols for the first play (step 608). In some embodiments, the game instruction set 220 initiating the first play (e.g., a first reel spin) may leverage the random number generator 232 to determine a final position of symbols 318 to be rendered in the array of cells 304. In some embodiments, the game instruction set 220 and/or the symbol slide instruction set 228 may leverage the random number generator 232 to determine a particular symbol in the array of cells 304 that is associated with a sliding symbol operation. The grid-based game may be arranged as an array of cells 304 having a specific presentation order that defines a specific position of each cell 312 in the array of cells 304 relative to one another. The symbols 318, including the particular symbol associated with the sliding symbol operation, are rendered in the array of cells 304 via the display screen 104 of the computational device 100 (step 612). This randomly-generated first sequence of symbols 318 are rendered to the array of cells 304 such that each cell 312 in the array of cells 304 comprises a discrete symbol 318 in the first sequence of symbols 318. A discrete symbol may comprise any symbol, including a blank symbol, associated with the grid-based game that has been randomly generated for a specific cell 312 in the array of cells 304 from a predetermined group of symbols 318. As described in conjunction with FIGS. 4A-4E, the slidable symbol may be rendered along with an identifying mark 404. This identifying mark 404 may indicate to a player that a particular symbol is a slidable symbol, or associated with a slidable symbol operation, that can be moved to a new position in the array of cells 304 for a subsequent play.

Next, the method proceeds when a symbol movement input is received dragging the particular symbol from one cell 312 to another in the array of cells 304 (step 616). This movement may be provided by a player selecting the particular symbol in the cell 312 to which the particular symbol first appeared and then by sliding the particular symbol to a new cell position along an acceptable line in the array of cells 304. The player interacting with the computational device 100 may drag the particular symbol 318 in the rendered first sequence of symbols identified as being a slidable symbol from an associated cell 312 (e.g., the first cell in which the particular symbol is rendered) in the array of cells 304 to a second cell (e.g., a different cell) in the array of cells 304. Examples of this movement input, and acceptable lines of movement, etc. are described in conjunction with FIGS. 4A-4E above.

The method may then determine subsequent play information based on the dragged position of the particular symbol being in a different dragged-to cell 312 in the array of cells 304 (step 620). In some embodiments, this subsequent play information may include determining at least one of odds of winning associated with the particular symbol being in the dragged-to cell 312, a number of subsequent plays available to the player for the particular symbol being in the dragged-to cell 312, whether any odds need to be adjusted for a potential payment amount to comport with gaming regulations, etc. The method may proceed by rendering a confirmation request message regarding the dragged-to position of the particular symbol and subsequent play information (step 624). This confirmation request message may be rendered as a pop-up window 504 and the subsequent play information may be rendered to a subsequent play information area 506 of the pop-up window 504, as described in conjunction with FIG. 5A above.

The method may continue by determining whether a second play input is received from the player (step 628). The second play input may comprise a confirmation provided by the player via selecting the "yes" icon 508 of the pop-up window 504, selecting a predetermined button 108, inserting coins, cash, tickets, vouchers, etc., or performing some other action at the computational device 100 that indicates a desire to initiate the second game play with the slidable symbol maintained in the dragged-to cell 312. In some embodiments, the second play input may correspond to a button press, a touch of a screen, a lever actuation, a gesture, and/or some other physical input provided by the player. The second play input initiates a second play of the grid-based game with the particular symbol maintained in the second cell 312 of the array of cells 304. If the player fails to provide the second play input, the method may return to step 616 allowing the player to reposition the particular symbol, or slidable symbol, to a different dragged-to cell 312 in the array of cells 304.

In response to the player providing the second play input, the method continues by maintaining the particular symbol in the dragged-to cell and generating (e.g., randomly) a second sequence of symbols to the array of cells 304 other than for the dragged-to cell for the second play (step 632). In some embodiments, the game instruction set 220 initiating the second play (e.g., a second reel spin) may leverage the random number generator 232 to determine a final position of symbols 318 to be rendered in the array of cells 304 excluding the maintained particular symbol in the dragged-to cell. These symbols 318, including the particular symbol associated with the sliding symbol operation that is maintained in the dragged-to cell, are rendered in the array of cells 304 via the display screen 104 of the computational device 100 (step 636).

After the second game play is completed, the game instruction set 220 may evaluate symbols 318 laid out in the array of symbols 304 (step 640). The evaluation of symbols 318 may include determining which paylines 120 will be subject to evaluation and whether any of the selected paylines 120 have a predetermined combination of symbols 318 provided thereon. In some embodiments, the evaluation of the symbols may comprise determining, based on a position of the particular symbol maintained (e.g., in the dragged-to cell 312) and a position of each symbol 318 in the second sequence of symbols relative to the presentation order, a game outcome of the second play of the grid-based game. In one embodiment, the game instruction set 220 will evaluate the symbols 318 that land on a particular payline 120 or a plurality of paylines 120 to determine if the subsequent play resulted in a predetermined game outcome. This predetermined game outcome may include winning a prize, winning playing credit, winning money, winning a bonus spin, achieving a game achievement, etc. Depending on the number of plays associated with the particular symbol and slidable symbol feature (e.g., being greater than one, etc.), the method may continue by receiving another subsequent play input where at least step 632 through step 640 are repeated for each available subsequent play. In some embodiments, the method may allow the player to move the particular symbol to yet another different cell between plays. In this example, the method may repeat steps 616 through 640.

Figure 7:
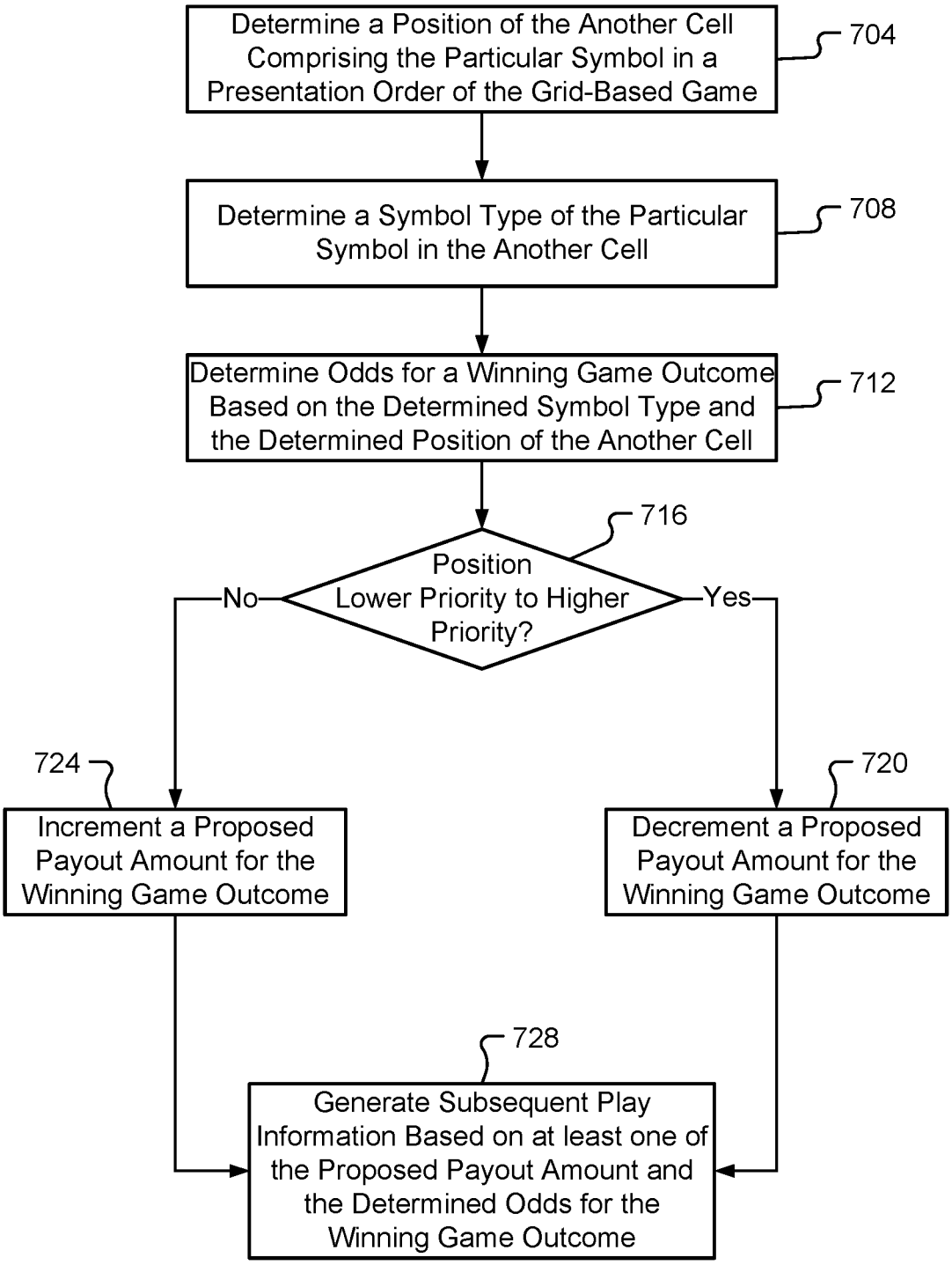
FIG. 7 is a flow diagram of an example process for determining subsequent play information associated with performing a sliding symbol operation in the grid-based game.

FIG. 7 is a flow diagram of an example process for determining subsequent play information associated with performing a sliding symbol operation in the grid-based game. The methods described herein may be run as a set of instructions on a computational device 100 and/or some other server in communication with the computational device 100. In some embodiments, the set of instructions may be part of an application installed on the computational device 100. In some embodiments, the method for determining subsequent play information may be performed as part of step 620, or in response to step 616, of the flow diagram described in conjunction with FIG. 6. The method may begin by determining a position of the dragged-to cell comprising the particular symbol (e.g., the slidable symbol) in a presentation order of the grid-based game (step 704). Determining the position of the dragged-to cell may comprise referring to game rules that define positions of each cell 312 and a presentation order in the array of cells 304 for the grid-based game. The presentation order may define the priority of each position in the array of cells 304. Cells 312 having a higher priority in the presentation order may have a higher chance of winning in a subsequent play while cells 312 having a lower priority in the presentation order, and vice versa.

Next, the method may proceed by determining a symbol type of the particular symbol (step 708). As provided above, when a particular symbol has been dragged from one cell 312 to another cell 312, the symbol type associated with the particular symbol remains the same as when it first appeared. If the symbol type of the particular symbol was a "cherry" when the particular symbol identified as being the slidable symbol appeared, then any movement of the particular symbol (e.g., to another cell 312 in the array of cells 304) will not change the symbol type from the "cherry." Stated another way, the symbol type for the particular symbol remains the same while it is able to be moved and when it is eventually moved from one cell 312 to another in the array of cells 304. Depending on the rules of the grid-based game, different symbol types may have different values, in step 708, the symbol type for the particular symbol is determined to ascertain a value of the symbol in the grid-based game. The value of a symbol in the grid-based game may affect a payout amount for a winning game outcome (e.g., a winning sequence of symbols, etc.). For instance, the higher the value of the symbol, the higher the payout amount and vice versa.

The method may continue by determining odds for a winning game outcome based on the determined symbol type and the determined position of the another, dragged-to, cell (step 712). The odds, or chances, of winning may be based on a combination of the position of the dragged-to cell in the presentation order and the value of the symbol type associated with the particular symbol. For instance, if the symbol type of the particular symbol is determined to have the highest value in the grid-based game, but the position of the dragged-to cell in the presentation order is associated with the lowest priority, the odds of obtaining a winning game outcome (e.g., a winning sequence of symbols, etc.) would be lower than if the same particular symbol was positioned in the cell in the presentation order that is associated with the highest priority.

In some embodiments, the method may determine whether the particular symbol was moved from a cell having a lower priority to a cell having a higher priority (step 716). These priorities may correspond to the priorities of each column 116*a*-116*e* described above. Depending on the movement of the particular symbol from a lower priority to a higher priority or from a higher priority to a lower priority, the proposed payout amount for a winning game outcome in a subsequent play may be altered. For instance, if the particular symbol is moved from a lower priority position to a higher priority position in the array of cells 304, the proposed payout amount for a winning game outcome may be decreased, or decremented (step 720). On the other hand, if the particular symbol is moved from a higher priority position to a lower priority position in the array of cells 304, the proposed payout amount for a winning game outcome may be increased, or incremented (step 724). In this manner, a player may be encouraged to move the particular symbol to a lower priority position as part of the sliding symbol operation to increase a potential payout even though the chances of winning, with the particular symbol in the lower priority position, may decrease. Alternatively, a player may be encouraged to move the particular symbol to a higher priority position as part of the sliding symbol operation to increase chances of winning even though the potential payout may be lower than if the particular symbol were moved to a lower priority position in the presentation order.

Based on at least one of the proposed payout amount and the determined odds for the winning game outcome, the method may proceed by generating subsequent play information for the next play where the sliding symbol operation is enabled (step 728). In some embodiments, this subsequent play information may be rendered to a pop-up window 504, for example, in a subsequent play information area 506, as described in conjunction with FIG. 5A. Examples of the subsequent play information may include, but are in no way limited to, chances of winning with the particular symbol in the dragged-to position, chances of losing with the particular symbol in the dragged-to position, a proposed payout amount should the subsequent play result in a winning sequence of symbols or game outcome, a number of plays where the particular symbol is maintained in the dragged-to position, etc., and/or combinations thereof. The subsequent play information may provide a player with further information to evaluate their chances of winning or losing with associated proposed payout amounts when determining where to drag or slide the particular symbol during a sliding symbol operation. Among other things, this information may assist a player in determining whether to provide a confirmation input and continue playing with the particular symbol oriented in a particular position, or cell 312, of the array of cells 304 or reposition the particular symbol to alter a behavior of the grid-based game.

A number of variations and modifications of the disclosure can be used. It would be possible to provide for some features of the disclosure without providing others.

The present disclosure contemplates a variety of different gaming systems each having one or more of a plurality of different features, attributes, or characteristics. A "gaming system" as used herein refers to various configurations of: (a) one or more central servers, central controllers, or remote hosts; (b) one or more electronic gaming machines such as those located on a casino floor; and/or (c) one or more personal gaming devices, such as desktop computers, laptop computers, tablet computers or computing devices, personal digital assistants, mobile phones, and other mobile computing devices. Moreover, an EGM as used herein refers to any suitable electronic gaming machine which enables a player to play a game (including but not limited to a game of chance, a game of skill, and/or a game of partial skill) to potentially win one or more awards, wherein the EGM comprises, but is not limited to: a slot machine, a video poker machine, a video lottery terminal, a terminal associated with an electronic table game, a video keno machine, a video bingo machine located on a casino floor, a sports betting terminal, or a kiosk, such as a sports betting kiosk.

In various embodiments, the gaming system of the present disclosure includes: (a) one or more electronic gaming machines in combination with one or more central servers, central controllers, or remote hosts; (b) one or more personal gaming devices in combination with one or more central servers, central controllers, or remote hosts; (c) one or more personal gaming devices in combination with one or more electronic gaming machines; (d) one or more personal gaming devices, one or more electronic gaming machines, and one or more central servers, central controllers, or remote hosts in combination with one another; (e) a single electronic gaming machine; (f) a plurality of electronic gaming machines in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity and unless specifically stated otherwise, "EGM" as used herein represents one EGM or a plurality of EGMs, "personal gaming device" as used herein represents one personal gaming device or a plurality of personal gaming devices, and "central server, central controller, or remote host" as used herein represents one central server, central controller, or remote host or a plurality of central servers, central controllers, or remote hosts.

As noted above, in various embodiments, the gaming system includes an EGM (or personal gaming device) in combination with a central server, central controller, or remote host. In such embodiments, the EGM (or personal gaming device) is configured to communicate with the central server, central controller, or remote host through a data network or remote communication link. In certain such embodiments, the EGM (or personal gaming device) is configured to communicate with another EGM (or personal gaming device) through the same data network or remote communication link or through a different data network or remote communication link. For example, the gaming system includes a plurality of EGMs that are each configured to communicate with a central server, central controller, or remote host through a data network.

In certain embodiments in which the gaming system includes an EGM (or personal gaming device) in combination with a central server, central controller, or remote host, the central server, central controller, or remote host is any suitable computing device (such as a server) that includes at least one processor and at least one memory device or data storage device. As further described herein, the EGM (or personal gaming device) includes at least one EGM (or personal gaming device) processor configured to transmit and receive data or signals representing events, messages, commands, or any other suitable information between the EGM (or personal gaming device) and the central server, central controller, or remote host. The at least one processor of that EGM (or personal gaming device) is configured to execute the events, messages, or commands represented by such data or signals in conjunction with the operation of the EGM (or personal gaming device). Moreover, the at least one processor of the central server, central controller, or remote host is configured to transmit and receive data or signals representing events, messages, commands, or any other suitable information between the central server, central controller, or remote host and the EGM (or personal gaming device). The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM (or personal gaming device). Further, one, more than one, or each of the functions of the at least one processor of the EGM (or personal gaming device) may be performed by the at least one processor of the central server, central controller, or remote host.

In certain such embodiments, computerized instructions for controlling any games (such as any primary or base games and/or any secondary or bonus games) displayed by the EGM (or personal gaming device) are executed by the central server, central controller, or remote host. In such "thin client" embodiments, the central server, central controller, or remote host remotely controls any games (or other suitable interfaces) displayed by the EGM (or personal gaming device), and the EGM (or personal gaming device) is utilized to display such games (or suitable interfaces) and to receive one or more inputs or commands. In other such embodiments, computerized instructions for controlling any games displayed by the EGM (or personal gaming device) are communicated from the central server, central controller, or remote host to the EGM (or personal gaming device) and are stored in at least one memory device of the EGM (or personal gaming device). In such "thick client" embodiments, the at least one processor of the EGM (or personal gaming device) executes the computerized instructions to control any games (or other suitable interfaces) displayed by the EGM (or personal gaming device).

In various embodiments in which the gaming system includes a plurality of EGMs (or personal gaming devices), one or more of the EGMs (or personal gaming devices) are thin client EGMs (or personal gaming devices) and one or more of the EGMs (or personal gaming devices) are thick client EGMs (or personal gaming devices). In other embodiments in which the gaming system includes one or more EGMs (or personal gaming devices), certain functions of one or more of the EGMs (or personal gaming devices) are implemented in a thin client environment, and certain other functions of one or more of the EGMs (or personal gaming devices) are implemented in a thick client environment. In one such embodiment in which the gaming system includes an EGM (or personal gaming device) and a central server, central controller, or remote host, computerized instructions for controlling any primary or base games displayed by the EGM (or personal gaming device) are communicated from the central server, central controller, or remote host to the EGM (or personal gaming device) in a thick client configuration, and computerized instructions for controlling any secondary or bonus games or other functions displayed by the EGM (or personal gaming device) are executed by the central server, central controller, or remote host in a thin client configuration.

In certain embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a local area network (LAN) in which the EGMs (or personal gaming devices) are located substantially proximate to one another and/or the central server, central controller, or remote host. In one example, the EGMs (or personal gaming devices) and the central server, central controller, or remote host are located in a gaming establishment or a portion of a gaming establishment.

In other embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include a wide area network (WAN) in which one or more of the EGMs (or personal gaming devices) are not necessarily located substantially proximate to another one of the EGMs (or personal gaming devices) and/or the central server, central controller, or remote host. For example, one or more of the EGMs (or personal gaming devices) are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs (or personal gaming devices) are located. In certain embodiments in which the communication network includes a WAN, the gaming system includes a central server, central controller, or remote host and an EGM (or personal gaming device) each located in a different gaming establishment in a same geographic area, such as a same city or a same state. Gaming systems in which the communication network includes a WAN are substantially identical to gaming systems in which the communication network includes a LAN, though the quantity of EGMs (or personal gaming devices) in such gaming systems may vary relative to one another.

In further embodiments in which the gaming system includes: (a) an EGM (or personal gaming device) configured to communicate with a central server, central controller, or remote host through a data network; and/or (b) a plurality of EGMs (or personal gaming devices) configured to communicate with one another through a communication network, the communication network may include an internet (such as the Internet) or an intranet. In certain such embodiments, an Internet browser of the EGM (or personal gaming device) is usable to access an Internet game page from any location where an Internet connection is available. In one such embodiment, after the EGM (or personal gaming device) accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique player name and password combination assigned to the player. The central server, central controller, or remote host may, however, identify the player in any other suitable manner, such as by validating a player tracking identification number associated with the player; by reading a player tracking card or other smart card inserted into a card reader; by validating a unique player identification number associated with the player by the central server, central controller, or remote host; or by identifying the EGM (or personal gaming device), such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM (or personal gaming device). Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM (or personal gaming device) are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs (or personal gaming devices) to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

As should be appreciated by one skilled in the art, aspects of the present disclosure have been illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure have been described herein with reference to flowchart illustrations and/or block diagrams of methods, apparatuses (systems) and computer program products according to embodiments of the disclosure. It should be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

What is claimed is:

1. A gaming device, comprising:

a display device;

a processor coupled to the display device; and a memory coupled with and readable by the processor and storing therein instructions that, when executed by the processor, cause the processor to:

receive a first input from a player interacting with the gaming device initiating a first play of a grid-based game, the grid-based game arranged as an array of cells having a presentation order defining a specific position of each cell in the array of cells relative to one another, wherein the presentation order defining the specific position of each cell in the array of cells relative to one another comprises:

a first position for a cell in the array of cells comprising a first priority;

a second position for a cell in the array of cells comprising a second priority that is lower than the first priority; and a third position for a cell in the array of cells comprising a third priority that is lower than the first priority and lower than the second priority, respectively, wherein the first priority corresponds to a high probability of generating a winning sequence of symbols in the array of cells, the second priority corresponds to a medium probability of generating the winning sequence of symbols in the array of cells, and the third priority corresponds to a low probability of generating the winning sequence of symbols in the array of cells;

render, by the display device in response to receiving the first input, a randomly-generated first sequence of symbols to the array of cells, each cell in the array of cells comprising a discrete symbol in the first sequence of symbols;

receive a symbol movement input from the player interacting with the gaming device dragging a particular symbol in the rendered first sequence of symbols from a first cell in the array of cells to a second cell in the array of cells;

receive a second input from the player interacting with the gaming device initiating a second play of the grid-based game with the particular symbol maintained in the second cell;

render, in response to receiving the second input, the particular symbol in the second cell and a randomly-generated second sequence of symbols to the array of cells other than the second cell; and determine, based on a position of the particular symbol and a position of each symbol in the second sequence of symbols relative to the presentation order, a game outcome of the second play of the grid-based game.

2. The gaming device of claim 1, wherein, in rendering the randomly-generated first sequence of symbols to the array of cells, the instructions further cause the processor to:

determine a slidable symbol in the first sequence of symbols that is allowed to be moved to a different cell in the array of cells for at least one subsequent play of the grid-based game; and render, by the display device, an identifying mark associated with the slidable symbol indicating that the slidable symbol in the first sequence of symbols is allowed to be moved to the different cell.

3. The gaming device of claim 1, wherein dragging the particular symbol in the rendered first sequence of symbols from the first cell in the array of cells to the second cell in the array of cells comprises moving the particular symbol from a lower priority position in the presentation order to a higher priority position in the presentation order, and wherein the instructions further cause the processor to:

determine, based on moving the particular symbol from the lower priority position in the presentation order to the higher priority position in the presentation order, that chances of winning the grid-based game increase by an amount; and decrement, based on the amount, a proposed payout amount for the game outcome of the second play of the grid-based game that comprises the winning sequence of symbols in the array of cells.

4. The gaming device of claim 1, wherein dragging the particular symbol in the rendered first sequence of symbols from the first cell in the array of cells to the second cell in the array of cells comprises moving the particular symbol from a higher priority position in the presentation order to a lower priority position in the presentation order, and wherein the instructions further cause the processor to:

determine, based on moving the particular symbol from the higher priority position in the presentation order to the lower priority position in the presentation order, that chances of winning the grid-based game decrease by an amount; and increment, based on the amount, a proposed payout amount for the game outcome of the second play of the grid-based game that comprises the winning sequence of symbols in the array of cells.

5. The gaming device of claim 1, wherein the instructions further cause the processor to:

determine a bet amount placed by the player interacting with the gaming device; and determine, based on the bet amount, a number of plays of the grid-based game the particular symbol is maintained in the second cell, wherein the number of plays increases when the bet amount is above a predetermined threshold, and wherein the number of plays decreases when the bet amount falls below the predetermined threshold.

6. The gaming device of claim 1, wherein the symbol movement input dragging the particular symbol from the first cell to the second cell is provided in any direction from the first cell along a line between the first cell and the second cell in the array of cells.

7. The gaming device of claim 1, wherein the grid-based game is a reel-spin game and the array of cells comprises cells arranged in a plurality of rows and reel columns, wherein a payline connects a plurality of cells in the array of cells, and wherein the winning sequence of symbols in the array of cells comprises the plurality of cells in the array of cells along the payline.

8. The gaming device of claim 1, wherein the grid-based game is a matching game, wherein the winning sequence of symbols comprises two or more matching symbols, and wherein a payout amount for the winning sequence of symbols increases as a number of matching symbols in the winning sequence of symbols increases.

9. A method, comprising:

receiving, by a processor of a gaming device, a first input from a player interacting with the gaming device initiating a first play of a grid-based game, the grid-based game arranged as an array of cells having a presentation order defining a specific position of each cell in the array of cells relative to one another; wherein the presentation order defining the specific position of each cell in the array of cells relative to one another comprises:

a first position for a cell in the array of cells comprising a first priority;

a second position for a cell in the array of cells comprising a second priority that is lower than the first priority; and a third position for a cell in the array of cells comprising a third priority that is lower than the first priority and lower than the second priority, respectively, wherein the first priority corresponds to a high probability of generating a winning sequence of symbols in the array of cells, the second priority corresponds to a medium probability of generating the winning sequence of symbols in the array of cells, and the third priority corresponds to a low probability of generating the winning sequence of symbols in the array of cells;

rendering, by a display device of the gaming device in response to receiving the first input, a randomly-generated first sequence of symbols to the array of cells, each cell in the array of cells comprising a discrete symbol in the first sequence of symbols;

receiving, via a user interface of the gaming device, a symbol movement input from the player interacting with the gaming device dragging a particular symbol in the rendered first sequence of symbols from a first cell in the array of cells to a second cell in the array of cells;

receiving, via the user interface of the gaming device, a second input from the player interacting with the gaming device initiating a second play of the grid-based game with the particular symbol maintained in the second cell;

rendering, by the display device of the gaming device in response to receiving the second input, the particular symbol in the second cell and a randomly-generated second sequence of symbols to the array of cells other than the second cell; and determining, by the processor of the gaming device based on a position of the particular symbol and a position of each symbol in the second sequence of symbols relative to the presentation order, a game outcome of the second play of the grid-based game.

10. The system of claim 9, wherein, in causing the randomly-generated first sequence of symbols to be rendered to the array of cells, the instructions further comprise:

instructions that determine a slidable symbol in the first sequence of symbols that is allowed to be moved to a different cell in the array of cells for at least one subsequent play of the grid-based game; and instructions that cause to be rendered an identifying mark associated with the slidable symbol indicating that the slidable symbol in the first sequence of symbols is allowed to be moved to the different cell.

11. The system of claim 10, wherein the instructions further comprise:

instructions that determine a priority of a position of the first cell and a priority of a position of the second cell in the array of cells in the presentation order; and instructions that, based on the determined priorities relative to one another, adjust a proposed payout amount for the game outcome of the second play of the grid-based game that comprises a winning sequence of symbols in the array of cells.

12. The system of claim 9, wherein the instructions further comprise:

instructions that determine a bet amount placed by the player interacting with the gaming device; and instructions that determine a number of plays of the grid-based game the particular symbol is maintained in the second cell, wherein the number of plays increases when the bet amount is above a predetermined threshold, and wherein the number of plays decreases when the bet amount falls below the predetermined threshold.

13. The system of claim 9, wherein the instructions further comprise:

instructions that determine the winning sequence of symbols in the array of cells from at least one of a first line of symbols in the array of cells running in a first direction and from a second line of symbols in the array of cells running in a second direction.

* * * * *